US012130054B2

(12) United States Patent
Hatomura et al.

(10) Patent No.: US 12,130,054 B2
(45) Date of Patent: Oct. 29, 2024

(54) AIR-CONDITIONING APPARATUS

(71) Applicant: Mitsubishi Electric Corporation, Tokyo (JP)

(72) Inventors: Takeshi Hatomura, Tokyo (JP); Satoru Yanachi, Tokyo (JP); Takuya Matsuda, Tokyo (JP); Hiroyuki Okano, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 567 days.

(21) Appl. No.: 17/607,379

(22) PCT Filed: Jun. 25, 2019

(86) PCT No.: PCT/JP2019/025173

§ 371 (c)(1),
(2) Date: Oct. 28, 2021

(87) PCT Pub. No.: WO2020/261387

PCT Pub. Date: Dec. 30, 2020

(65) Prior Publication Data

US 2022/0205687 A1 Jun. 30, 2022

(51) Int. Cl.

| | |
|---|---|
| ***F25B 13/00*** | (2006.01) |
| ***F25B 1/00*** | (2006.01) |
| ***F25B 25/00*** | (2006.01) |

(52) U.S. Cl.

CPC ..... *F25B 13/00* (2013.01); *F25B 25/005* (2013.01); *F25B 1/00* (2013.01); *F25B 2313/003* (2013.01);

(Continued)

(58) Field of Classification Search

None

See application file for complete search history.

(56) References Cited

U.S. PATENT DOCUMENTS 2,004,503 A * 6/1935 Hulse ..... F25B 17/083 62/480
3,188,821 A * 6/1965 Chellis ..... F25B 9/14 62/6

(Continued)

FOREIGN PATENT DOCUMENTS

CN 110425764 A * 11/2019 ..... F25B 13/00
EP 1371911 A1 * 12/2003 ..... F25B 13/00

(Continued)

OTHER PUBLICATIONS

International Search Report of the International Searching Authority mailed Sep. 3, 2019 in corresponding International Patent Application No. PCT/JP2019/025173 (and English translation).

*Primary Examiner* — Jenna M Maroney
(74) *Attorney, Agent, or Firm* — Posz Law Group, PLC

(57) ABSTRACT

An air-conditioning apparatus includes an outdoor unit and a relay unit. The outdoor unit includes a compressor compressing and discharging refrigerant and a heat-source-side heat exchanger performing heat exchange between the refrigerant and outside air. The relay unit and the outdoor unit forms a refrigerant circuit. The outdoor unit includes first and flow switching devices each switching an associated flow passage for the refrigerant between a plurality of flow passages, according to an operation mode. An outflow pipe and an inflow pipe through which refrigerant flows from the outdoor unit to the relay unit and from the relay unit into the outdoor unit, respectively, are between the outdoor unit and the relay unit. The first flow switching device is connected to the compressor, the second flow switching device, and the outflow pipe. The second flow switching device is connected to the first flow switching device and the inflow pipe.

20 Claims, 14 Drawing Sheets

(52) U.S. Cl.
CPC . *F25B 2313/006* (2013.01); *F25B 2313/0231* (2013.01); *F25B 2313/0233* (2013.01)

(56) References Cited

U.S. PATENT DOCUMENTS 4,467,621 A * 8/1984 O'Brien ..... F25B 1/00 62/324.1
4,573,497 A * 3/1986 White ..... F25B 41/26 137/625.29
4,827,979 A * 5/1989 Boddy ..... B01D 35/12 137/625.29
6,244,057 B1 * 6/2001 Yoshida ..... F25B 47/025 62/278
6,295,828 B1 * 10/2001 Koo ..... F16K 11/0525 137/625.29
6,883,345 B2 * 4/2005 Lee ..... F25B 13/00 62/511
7,895,850 B2 * 3/2011 Kitsch ..... F25B 41/26 62/278
8,091,377 B2 * 1/2012 Jeong ..... F25B 13/00 62/200
9,822,996 B2 * 11/2017 Deng ..... F25B 47/02
10,094,604 B2 * 10/2018 Yamashita ..... F25B 7/00
2003/0230107 A1 * 12/2003 Lee ..... F25B 13/00 62/504
2004/0035135 A1 * 2/2004 Park ..... F25B 13/00 62/223
2005/0086970 A1 * 4/2005 Lifson ..... F25B 13/00 62/324.1
2011/0048053 A1 * 3/2011 Sekine ..... F25B 13/00 62/324.6
2011/0048054 A1 * 3/2011 Sekine ..... F25B 13/00 62/335
2011/0192184 A1 * 8/2011 Yamashita ..... F24F 3/06 62/196.1
2012/0297812 A1 * 11/2012 Takata ..... F25B 25/005 62/324.6
2012/0304675 A1 * 12/2012 Motomura ..... F24F 3/06 62/156
2013/0145785 A1 * 6/2013 Nobuhiro ..... F25B 47/025 62/160
2013/0167559 A1 * 7/2013 Kim ..... F24D 5/12 62/324.6
2015/0292756 A1 * 10/2015 Takenaka ..... F24F 5/001 62/160
2015/0300714 A1 * 10/2015 Ishimura ..... F25B 49/02 62/228.1
2016/0084535 A1 * 3/2016 Toya ..... F25B 13/00 62/175
2022/0090816 A1 * 3/2022 Park ..... F24F 3/065
2022/0205687 A1 * 6/2022 Hatomura ..... F25B 41/26
2022/0307736 A1 * 9/2022 Welch ..... F25B 30/02
2022/0381483 A1 * 12/2022 Gyotoku ..... F25B 13/00
2024/0183584 A1 * 6/2024 Butler ..... F25B 13/00

FOREIGN PATENT DOCUMENTS

EP 1371921 A1 * 12/2003 ..... F24F 1/00
EP 2889559 A1 * 7/2015 ..... F24F 11/83
GB 2598683 A * 3/2022 ..... F24F 1/30
JP H07-280375 A 10/1995
JP 2757584 B2 5/1998
JP 2001-066006 A 3/2001
JP 2015-222157 A 12/2015
KR 102366587 B1 * 2/2022
KR 102439236 B1 * 9/2022
WO WO-2009028193 A1 * 3/2009 ..... F25B 41/046
WO 2010/049998 A1 5/2010
WO WO-2011099059 A1 * 8/2011 ..... F25B 13/00
WO WO-2011099074 A1 * 8/2011 ..... F25B 13/00
WO WO-2012049704 A1 * 4/2012 ..... F24F 13/30
WO WO-2014020651 A1 * 2/2014 ..... F24F 11/83
WO WO-2014045358 A1 * 3/2014 ..... F24F 11/83
WO WO-2014141381 A1 * 9/2014 ..... F24F 1/0003
WO WO-2016170575 A1 * 10/2016 ..... F25B 13/00
WO WO-2018020654 A1 * 2/2018 ..... F25B 13/00
WO WO-2020261387 A1 * 12/2020 ..... F24F 11/86
WO WO-2021005737 A1 * 1/2021 ..... F24F 1/30
WO WO-2021053820 A1 * 3/2021 ..... F24F 11/41

* cited by examiner

COOLING MAIN OPERATION MODE

HEATING EMPHASIS COOLING MAIN OPERATION MODE

AIR-CONDITIONING APPARATUS

CROSS REFERENCE TO RELATED APPLICATION

This application is a U.S. national stage application of PCT/JP2019/025173 filed on Jun. 25, 2019, the contents of which are incorporated herein by reference.

TECHNICAL FIELD

The present disclosure relates to an air-conditioning apparatus including an outdoor unit and a relay unit that forms together with the outdoor unit, a refrigerant circuit.

BACKGROUND ART

In an existing air-conditioning apparatus, an outdoor unit and a relay unit are connected to each other by two connection pipes, thereby enabling a cooling and heating mixed operation to be performed (see, for example, Patent Literature 1). In a technique described in Patent Literature 1, check valves are provided at a plurality of refrigerant pipes in the outdoor unit. Thus, in either a cooling operation or a heating operation, refrigerants in two connection pipes that connect the outdoor unit and the relay unit are made to flow in the opposite directions such that in each of the connection pipes, the refrigerant necessarily flows in a single direction only. Therefore, a stable operation of the air-conditioning apparatus can be achieved.

CITATION LIST

Patent Literature

Patent Literature 1: Japanese Patent No. 2757584

SUMMARY OF INVENTION

Technical Problem

However, in the technique of Patent Literature 1, during the cooling operation, a pressure loss is caused by the check valves provided at the plurality of refrigerant pipes in the outdoor unit, thus deteriorating a cooling performance.

The present disclosure is applied to solve the above problem, and relates to an air-conditioning apparatus in which refrigerants in two pipes that connect an outdoor unit to a relay unit are made to flow in the opposite directions such that in the each of the pipes, the refrigerant necessarily flows in a single direction only, whereby it is possible to reduce deterioration of the cooling performance while achieving a stable operation of the air-conditioning apparatus.

Solution to Problem

An air-conditioning apparatus according to an embodiment of the present disclosure includes: an outdoor unit including a compressor and a heat-source-side heat exchanger, the compressor being provided to compress refrigerant and discharge the compressed refrigerant, the heat-source-side heat exchanger being provided to cause heat exchange to be performed between the refrigerant and outside air; and a relay unit provided to form, together with the outdoor unit, a refrigerant circuit. The outdoor unit includes a first flow switching device and a second flow switching device each of which switches an associated flow passage for the refrigerant between a plurality of flow passages, in accordance with an operation mode. An outflow pipe through which the refrigerant flows from the outdoor unit to the relay unit and an inflow pipe through which the refrigerant flows from the relay unit into the outdoor unit are provided between the outdoor unit and the relay unit. The compressor and the first flow switching device are connected to each other. The first flow switching device and the second flow switching device are connected to each other. The first flow switching device and the outflow pipe are connected to each other. The inflow pipe and the second flow switching device are connected to each other.

Advantageous Effects of Invention

In an air-conditioning apparatus according to an embodiment of the present disclosure, an outdoor unit includes a first flow switching device and a second flow switching device each of which switches an associated flow passages for refrigerant between a plurality of flow passages, in accordance with an operation mode. An outflow pipe through which the refrigerant flows from the outdoor unit to the relay unit and an inflow pipe through which the refrigerant flows from the relay unit flows into the outdoor unit are provided between the outdoor unit and the relay unit. The compressor and the first flow switching device are connected to each other. The first flow switching device and the second flow switching device are connected to each other. The first flow switching device and the outflow pipe are connected to each other. The inflow pipe and the second flow switching device are connected to each other. Thus, the flow directions of refrigerants in the outflow pipe and the inflow pipe that connect the compressor and the relay unit are opposite to each other and are each necessarily fixed to a single direction, and a stable operation of the air-conditioning apparatus can be achieved. Furthermore, the outdoor unit includes the first flow switching device and the second flow switching device in place of check valves. Because a check valve that causes a pressure loss during a cooling operation is not provided, a pressure loss can be reduced, and deterioration of the cooling performance can be reduced. Therefore, the flow directions of refrigerants in the outflow pipe and the inflow pipe that connect the compressor and the relay unit are opposite to each other and are each necessarily fixed to a single direction, and deterioration of the cooling performance can be reduced at the same time as a stable operation of the air-conditioning apparatus can be achieved.

DESCRIPTION OF EMBODIMENTS

Embodiments will be described with reference to the drawings. In each of the above figures, components that are the same as or equivalent to those in a previous figure or figures are denoted by the same reference signs, and the same is true of the entire text of the present specification. Furthermore, in sectional views, hatching is omitted as appropriate in view of visibility. Moreover, the configurations of components as described in the entire text of the present specification are merely examples; that is, the configurations of the components are not limited to the configurations of the components as described in the entire text.

Embodiment 1

<Configuration of Air-Conditioning Apparatus 100>

Figure 1:
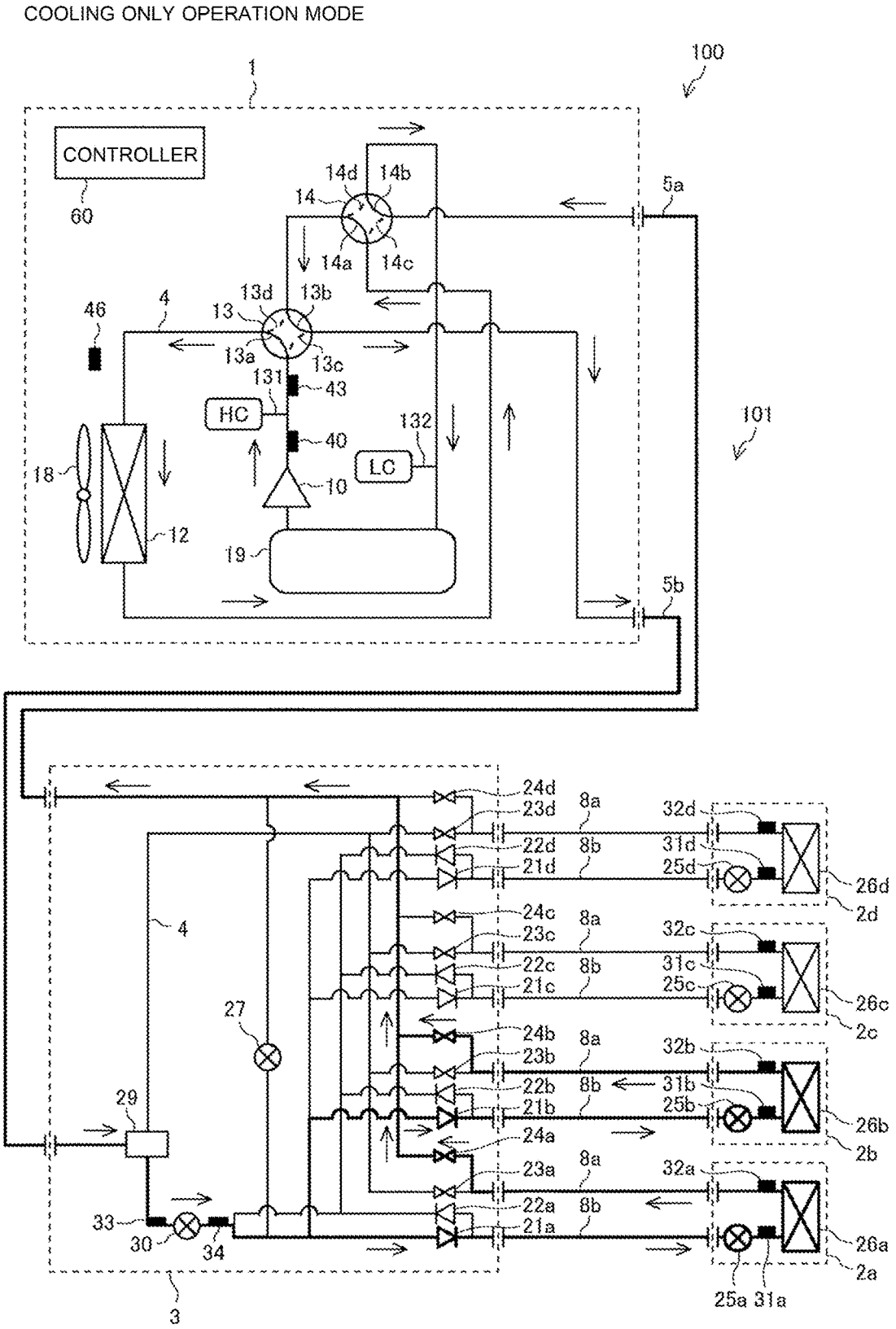
FIG. 1 is a refrigerant circuit diagram illustrating an air-conditioning apparatus according to Embodiment 1 in a cooling only operation mode.

FIG. 1 is a refrigerant circuit diagram illustrating an air-conditioning apparatus 100 according to Embodiment 1 in the case where the air-conditioning apparatus 100 is in a cooling only operation mode. As illustrated in FIG. 1, the air-conditioning apparatus 100 includes an outdoor unit 1 that is a heat source unit, four indoor units 2*a*, 2*b*, 2*c*, and 2*d* (which may be hereinafter each referred to as an indoor unit 2 without a suffix), and a relay unit 3 that is provided between the outdoor unit 1 and the indoor units 2*a* to 2*d*. The outdoor unit 1 and the relay unit 3 are connected by an outflow pipe 5*b* and an inflow pipe 8*a* through which refrigerant flows. The relay unit 3 and each of the indoor units 2*a* to 2*d* are connected by branch pipes 8*a* and 8*b* through which refrigerant flows. Cooling energy or heating energy generated at the outdoor unit 1 is supplied to the indoor units 2*a* to 2*d* through the relay unit 3.

The outflow pipe 5*b* and the inflow pipe 8*a* connect the outdoor unit 1 and the relay unit 3. In the outflow pipe 5*b*, high-pressure refrigerant flows. In the inflow pipe 5*a*, refrigerant whose pressure is lower than the pressure of the refrigerant that flows in the outflow pipe 5*b* flows. The relay unit 3 and each of the indoor units 2*a* to 2*d* are connected by two branch pipes 8*a* and 8*b*. As described above, the outdoor unit 1 and the relay unit 3 are connected by two refrigerant pipes, and the relay unit 3 and each of the indoor units 2*a* to 2*d* are also connected by two refrigerant pipes. Thus, the air-conditioning apparatus 100 can be easily installed.

<Configuration of Outdoor Unit 1>

The outdoor unit 1 includes a compressor 10 that compresses refrigerant and discharges the compressed refrigerant. The outdoor unit 1 includes a heat-source-side heat exchanger 12 that causes heat exchange to be performed between refrigerant and outside air. The outdoor unit 1 includes a heat-source-side fan 18 that supplies outside air to the heat-source-side heat exchanger 12. At the heat-source-side heat exchanger 12, heat exchange is performed between air supplied by the heat-source-side fan 18 and refrigerant, and the refrigerant is thus condensed or evaporated. The outdoor unit 1 includes a first flow switching device 13 and a second flow switching device 14 each of which performs switching between flow passages for refrigerant, depending on which of operation modes is set. The first flow switching device 13 is provided such that a first flow passage 13*a*, a second flow passage 13*b*, a third flow passage 13*c*, and a fourth flow passage 13*d* can be freely opened and closed. The second flow switching device 14 is provided such that a first flow passage 14*a*, a second flow passage 14*b*, a third flow passage 14*c*, and a fourth flow passage 14*d* can be freely opened and closed. The outdoor unit 1 includes an accumulator 19 in which refrigerant is accumulated. The outdoor unit 1 includes a controller 60 that controls various components.

The compressor 10 and the first flow switching device 13 are connected by a refrigerant pipe 4. The first flow switching device 13 and the second flow switching device 14 are connected by the refrigerant pipe 4. The first flow switching device 13 and the outflow pipe 5*b* are connected by the refrigerant pipe 4. The inflow pipe 5*a* and the second flow switching device 14 are connected by the refrigerant pipe 4.

In the outdoor unit 1, a discharge temperature sensor 43, a discharge pressure sensor 40, and an outside-air temperature sensor 46 are provided. The discharge temperature sensor 43 detects the temperature of the refrigerant discharged from the compressor 10, and outputs a discharge temperature detection signal. The discharge pressure sensor 40 detects the pressure of the refrigerant discharged from the compressor 10, and outputs a discharge pressure detection signal. The outside-air temperature sensor 46 is provided at part of the outdoor unit 1 where air flows into the heat-source-side heat exchanger 12. For example, the outside-air temperature sensor 46 detects the temperature of outside air, which is the temperature of air surrounding the outdoor unit 1, and outputs an outside air temperature detection signal.

<Configuration of Relay Unit 3>

The relay unit 3 forms, together with the outdoor unit 1, a refrigerant circuit 101. The relay unit 3 includes a gas-liquid separator 29, a first relay expansion device 30, and a second relay expansion device 27. The relay unit 3 includes a plurality of first opening and closing devices 23*a* to 23*d*, a plurality of second opening and closing devices 24*a* to 24*d*, a plurality of first backflow prevention devices 21*a* to 21*d*, and a plurality of second backflow prevention devices 22*a* to 22*d*.

In a cooling and heating mixed operation mode with a high cooling load, the gas-liquid separator 29 separates high-pressure two-phase gas-liquid refrigerant generated at the outdoor unit 1 into liquid refrigerant and gas refrigerant.

The gas-liquid separator 29 then causes the liquid refrigerant to flow into a lower pipe as illustrated in the figure, and supplies cooling energy to one or more of the indoor units 2. At the same time, the gas-liquid separator 29 also causes the gas refrigerant to flow into an upper pipe as illustrated in the figure, and supplies heating energy to a remaining one or ones of the indoor units 2. The gas-liquid separator 29 is provided in an inlet part of the relay unit 3 in the flow of refrigerant.

The first relay expansion device 30 has functions of a pressure reducing valve and an opening and closing valve. The first relay expansion device 30 reduces the pressure of liquid refrigerant to a predetermined pressure, and opens and closes a flow passage for the liquid refrigerant. The opening degree of the first relay expansion device 30 can be adjusted, for example, continuously or in steps. For example, an electronic expansion valve is used as the first relay expansion device 30. The first relay expansion device 30 is provided at a pipe that allows liquid refrigerant to flow out of the gas-liquid separator 29.

The second relay expansion device 27 has functions of a pressure reducing valve and an opening and closing valve. In a heating only operation mode, the second relay expansion device 27 opens a refrigerant flow passage thereof to cause refrigerant to flow into a low-pressure pipe on the outlet side of the relay unit 3. In a heating main operation mode, the second relay expansion device 27 adjusts the liquid flow rate of a bypass based on a load on an indoor side. The opening degree of the second relay expansion device 27 can be adjusted, for example, continuously or in steps. For example, an electronic expansion valve is used as the second relay expansion device 27.

The first opening and closing devices 23*a* to 23*d* are provided for the indoor units 2*a* to 2*d*, respectively. The first opening and closing devices 23*a* to 23*d* open and close flow passages for high-temperature and high-pressure gas refrigerant that is supplied to the indoor units 2*a* to 2*d*, respectively. The first opening and closing devices 23*a* to 23*d* are, for example, solenoid valves. The first opening and closing devices 23*a* to 23*d* are connected to respective gas-side pipes for the gas-liquid separator 29. The first opening and closing devices 23*a* to 23*d* have only to open and close the flow passages and may be expansion devices having a fully closing function.

The second opening and closing devices 24*a* to 24*d* are provided for the indoor units 2*a* to 2*d*, respectively. The second opening and closing devices 24*a* to 24*d* open and close flow passages for low-pressure and low-temperature gas refrigerant that has flowed out of the indoor units 2*a* to 2*d*, respectively. The second opening and closing devices 24*a* to 24*d* are, for example, solenoid valves. The second opening and closing devices 24*a* to 24*d* are connected to respective low-pressure pipes connected to the outlet side of the relay unit 3. The second opening and closing devices 24*a* to 24*d* have only to open and close flow passages and may be expansion devices having a fully closing function.

The first backflow prevention devices 21*a* to 21*d* are provided for the indoor units 2*a* to 2*d*, respectively. Each of the first backflow prevention devices 21*a* to 21*d* causes high-pressure refrigerant to flow into an associated one of the indoor units 2 when the associated indoor unit 2 is in the cooling operation. The first backflow prevention devices 21*a* to 21*d* are connected to respective pipes on the outlet side of the first relay expansion device 30. When one of the indoor units 2 is in the heating operation either in the cooling main operation mode or the heating main operation mode, an associated one of the first backflow prevention devices 21*a* to 21*d* can prevent medium-temperature and medium-pressure liquid refrigerant or two-phase gas-liquid refrigerant that cannot ensure a sufficient degree of subcooling from a load-side expansion device 25 (which is denoted by the reference sign "25" without suffix in this case, and which corresponds to an associated one of load-side expansion devices 25*a* to 25*b*) of the above one of the indoor units 2, from flowing into a load-side expansion device 25 of one of the indoor units 2 that is in the cooling operation. For example, check valves are used as the first backflow prevention devices 21*a* to 21*d*. The first backflow prevention devices 21*a* to 21*d* have only to prevent backflow of refrigerant and may be, for example, opening and closing devices or expansion devices having a fully closing function.

The second backflow prevention devices 22*a* to 22*d* are provided for the indoor units 2*a* to 2*d*, respectively. Each of the second backflow prevention devices 22*a* to 22*d* allows low-pressure gas refrigerant to flow thereinto from an associated one of the indoor units 2 when the associated indoor unit is in the heating operation. The second backflow prevention devices 22*a* to 22*d* are connected to respective pipes on the outlet side of the first relay expansion device 30. Each of the second backflow prevention devices 22*a* to 22*d* can prevent medium-temperature and medium-pressure liquid refrigerant or two-phase refrigerant that cannot ensure a sufficient degree of subcooling from the first relay expansion device 30 in the cooling main operation mode or the heating main operation mode from flowing into a load-side expansion device 25 of the associated indoor unit 2 when the associated indoor unit 2 is in the cooling operation. Check valves are used as the second backflow prevention devices 22*a* to 22*d*. The second backflow prevention devices 22*a* to 22*d* have only to prevent backflow of refrigerant and may be, for example, opening and closing devices or expansion devices having a fully closing function.

In the relay unit 3, a first relay-expansion-device inlet-side pressure sensor 33 is provided on the inlet side of the first relay expansion device 30. The first relay-expansion-device inlet-side pressure sensor 33 detects the pressure of high-pressure refrigerant. A first relay-expansion-device outlet-side pressure sensor 34 is provided on the outlet side of the first relay expansion device 30. The first relay-expansion-device outlet-side pressure sensor 34 detects an intermediate pressure of liquid refrigerant on the outlet side of the first relay expansion device 30 in the cooling main operation mode.

<Configuration of Indoor Units 2*a* to 2*d*>

The indoor units 2*a* to 2*d* are included in the refrigerant circuit 101. The indoor units 2*a* to 2*d* have the same configurations. The indoor unit 2*a* includes a load-side heat exchanger 26*a* and a load-side expansion device 25*a*. The indoor unit 2*b* includes a load-side heat exchanger 26*b* and a load-side expansion device 25*b*. The indoor unit 2*c* includes a load-side heat exchanger 26*c* and a load-side expansion device 25*c*. The indoor unit 2*d* includes a load-side heat exchanger 26*d* and a load-side expansion device 25*d*. Each of the load-side heat exchangers 26*a* to 26*d* is connected to the relay unit 3 by the refrigerant pipe 4 via the branch pipe 8*a* and 8*b*. At each of the load-side heat exchangers 26*a* to 26*d*, heat exchange is performed between refrigerant and air supplied from a load-side fan (not illustrated), thereby generating cooling air or heating air to be supplied to an indoor space. The opening degrees of the load-side expansion devices 25*a* to 25*d* can be adjusted, for example, continuously or in steps. For example, electronic expansion valves are used as the load-side expansion devices 25*a* to 25*d*. The load-side expansion devices 25*a* to 25*d* have functions of pressure-reducing valves and expansion valves. The load-side expansion devices 25*a* to 25*d* each reduce the pressure of refrigerant and expand the refrigerant. The load-side expansion devices 25*a* to 25*d* are provided upstream of the load-side heat exchangers 26*a* to 26*d* in the flow direction of refrigerant in the cooling only operation mode.

The indoor units 2*a* to 2*d* include respective inlet-side temperature sensors, that is, inlet-side temperature sensors 31*a* to 31*d* that detect temperatures of refrigerant that flows into the load-side heat exchangers 26*a* to 26*d*, respectively. The indoor units 2*a* to 2*d* include respective outlet-side temperature sensors, that is, outlet-side temperature sensors 32*a* to 32*d* that detect temperatures of refrigerant that has flowed out of the load-side heat exchangers 26*a* to 26*d*, respectively. The inlet-side temperature sensors 31*a* to 31*d* and the outlet-side temperature sensors 32*a* to 32*d* are, for example, thermistors. The inlet-side temperature sensors 31*a* to 31*d* and the outlet-side temperature sensors 32*a* to 32*d* each output a detection signal to the controller 60.

In FIG. 1, the four indoor units 2*a* to 2*d* are illustrated. However, the number of indoor units 2 may be two, three, or five or more.

<Configuration of First Flow Switching Device 13>

Figure 2:
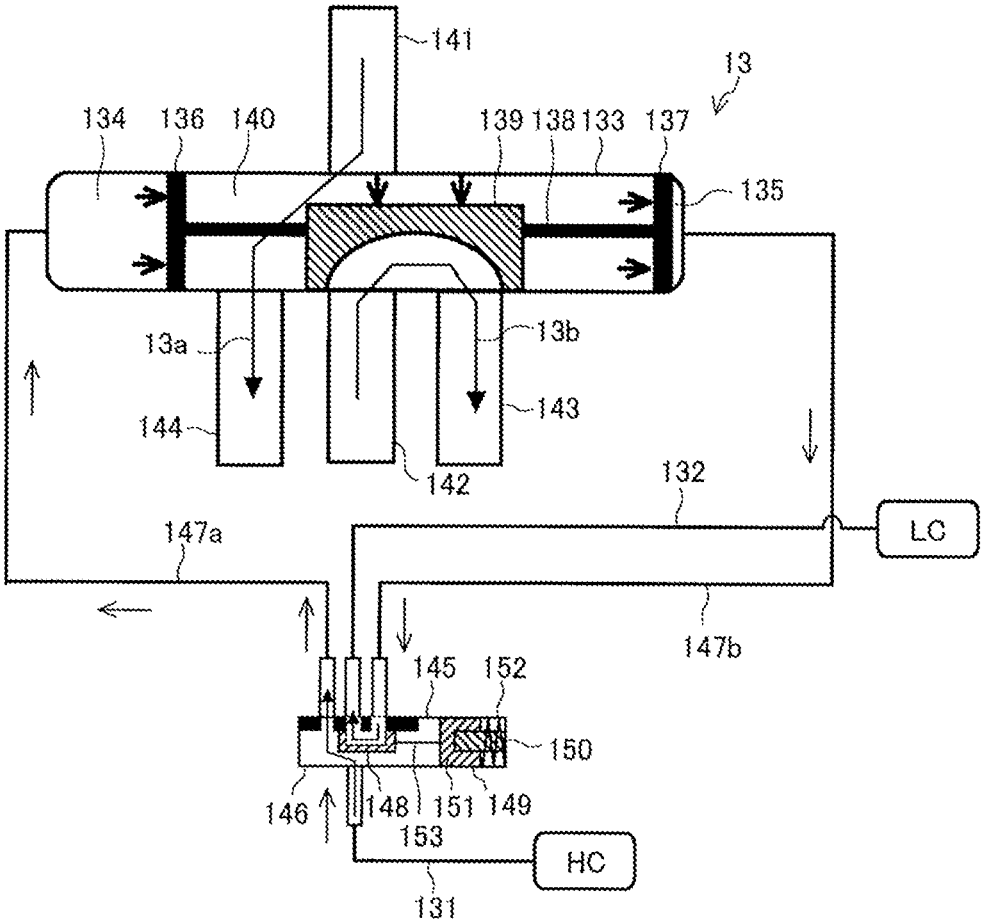
FIG. 2 is a schematic configuration diagram illustrating a first flow switching device in Embodiment 1 in the cooling only operation mode.

FIG. 2 is a schematic configuration diagram illustrating the first flow switching device 13 according to Embodiment 1 in the cooling only operation mode.

As illustrated in FIG. 1, the first flow switching device 13 is provided such that the first flow passage 13*a*, the second flow passage 13*b*, the third flow passage 13*c*, and the fourth flow passage 13*d* can be freely opened and closed. The second flow switching device 14 is provided such that the first flow passage 14*a*, the second flow passage 14*b*, the third flow passage 14*c*, and the fourth flow passage 14*d* can be freely opened and closed, as well as the first flow switching device 13.

As illustrated in FIG. 2, the first flow switching device 13 is a pilot four-way flow switching valve that switches a flow passage to be used, between the flow passages, because of a differential pressure. The second flow switching device 14 is also a pilot four-way flow switching valve that switches a flow passage to be used between the flow passages because of a differential pressure, as well as the first flow switching device 13. Only one of the first flow switching device 13 and the second flow switching device 14 may be a pilot four-way flow switching valve. The following description is made with respect to the case where the first flow switching device 13 is a pilot four-way flow switching valve. This case is merely an example. The second flow switching device 14 has the same configuration as the first flow switching device 13.

As illustrated in FIG. 2, the first flow switching device 13 includes a high-pressure connection pipe 131 and a low-pressure connection pipe 132. The high-pressure connection pipe 131 is connected with the atmosphere of refrigerant that has a higher pressure than the pressure of the atmosphere of low-pressure refrigerant with which the low-pressure connection pipe 132 is connected. As illustrated in FIG. 1, the high-pressure connection pipe 131 is connected with the atmosphere of high-pressure refrigerant between the discharge side of the compressor 10 and the first flow switching device 13. As illustrated in FIG. 1, the low-pressure connection pipe 132 is connected with the atmosphere of low-pressure refrigerant between the second flow switching device 14 and the suction side of the compressor 10.

As illustrated in FIG. 2, the first flow switching device 13 includes a first pressure chamber 134 and a second pressure chamber 135 that are provided in a first container 133 and connected with each other, and the pressure state of the first pressure chamber 134 and the pressure state of the second pressure chamber 135 are opposite to each other, since high-pressure refrigerant is connected with one of the first pressure chamber 134 and the second pressure chamber 135 by the low-pressure connection pipe 131, and low-pressure refrigerant is connected with the other of the first pressure chamber 134 and the second pressure chamber 135 by the high-pressure connection pipe 131. That is, when the first pressure chamber 134 is made in the high pressure state, the second pressure chamber 135 is made in the low pressure state, and when the first pressure chamber 134 is made in the low pressure state, the second pressure chamber 135 is made in the high pressure state. The first flow switching device 13 includes a first partitioning part 136 and a second partitioning part 137 that are provided between the first pressure chamber 134 and the second pressure chamber 135 in the first container 133 such that spaces in the first pressure chamber 134 and the second pressure chamber 135 can be increased and decreased in an inversely correlated manner. The first partitioning part 136 partitions the first container 133 in such a manner to define the first pressure chamber 134, and the second partitioning part 137 partitions the first container 133 in such a manner as to define the second pressure chamber 135. The first flow switching device 13 has a space 140 between the first partitioning part 136 and the second partitioning part 137, and a coupling part 138 that couples the first partitioning part 136 and the second partitioning part 137 to each other. The first flow switching device 13 has a first valve body part 139 that is slidably provided in the middle of the coupling part 138 between the first pressure chamber 134 and the second pressure chamber 135 such that the distance between the first valve body part 139 and the first pressure chamber 134 and the distance between the first valve body part 139 and the second pressure chamber 135 can be increased and decreased in an inversely correlated manner.

Four switching pipes 141, 142, 143, and 144 that form the first flow passage 13*a*, the second flow passage 13*b*, the third flow passage 13*c*, or the fourth flow passage 13*d* are connected with the space 140 between the first partitioning part 136 and the second partitioning part 137 of the first container 133. Specifically, the first flow switching device 13 includes the switching pipe 141 that is connected to inlet sides of the first flow passage 13*a* and the third flow passage 13*c*, the switching pipe 142 that is connected to inlet sides of the second flow passage 13*b* and the fourth flow passage 13*d*, the switching pipe 143 that is connected to the outlet side of the second flow passage 13*b* and the third flow passage 13*c*, and the switching pipe 144 that is connected to the outlet sides of the first flow passage 13*a* and the fourth flow passage 13*d*.

Of the four switching pipes 141, 142, 143, and 144, the switching pipes 142, 143, and 144 are provided in parallel in a slidable range of the first valve body part 139. Specifically, the switching pipe 142, which is connected to the inlet sides of the second flow passage 13*b* and the fourth flow passage 13*d*, is provided between the switching pipe 143, which is connected to the outlet side of the second flow passage 13*b* and the third flow passage 13*c*, and the switching pipe 144, which is connected to the outlet side of the first flow passage 13*a* and the fourth flow passage 13*d*.

The first valve body part 139 causes the switching pipe 142, which is connected to the inlet side of the second flow passage 13*b* and the fourth flow passage 13*d*, to communicate with the inside of the first valve body part 139 at all times, and is slid in a slidable range to cause one of the switching pipe 143 and the switching pipe 144, each of which is connected to the outlet side of an associated one of the second flow passage 13*b* and the fourth flow passage 13*d*, to communicate with the inside of the first valve body part 139, in accordance with the pressures of refrigerant connected with the first pressure chamber 134 and the second pressure chamber 135.

The switching pipe 141 connected to the inlet side of the first flow passage 13*a*, which is located outside the first valve body part 139, is connected to the switching pipe 144 connected to the outlet side of the first flow passage 13*a*, with the space 140 interposed between the switching pipe 141 and the switching pipe 144. In this case, the switching pipe 144 does not form the second flow passage 13*b*. Furthermore, the switching pipe 141 connected to the inlet side of the third flow passage 13*c*, which are located outside the first valve body part 139, is connected to the switching pipe 143 connected to the outlet side of the third flow passage 13*c*, with the space 140 interposed between the switching pipe 141 and the switching pipe 143. In this case, the switching pipe 143 does not form the fourth flow passage 13*d*. Thus, high-pressure refrigerant flows in the space 140 between the first partitioning part 136 and the second partitioning part 137 of the first container 133. Since the high-pressure refrigerant flows in the space 140 between the first partitioning part 136 and the second partitioning part 137, the first valve body part 139 is pushed onto the inner wall of the first container 133, and the high-pressure refrigerant is prevented from flowing into the first valve body part 139 in which low-pressure refrigerant flows.

<Configuration of Pressure Switching Unit 145>

As illustrated in FIG. 2, the first flow switching device 13 includes a pressure switching unit 145 that switches the flow of refrigerant between the flow of high-pressure refrigerant from the high-pressure connection pipe 131 to the first flow switching device 13 and the flow of low-pressure refrigerant from the first flow switching device 13 to the low-pressure connection pipe 132.

The pressure switching unit 145 includes a second container 146 to which the high-pressure connection pipe 131 and the low-pressure connection pipe 132 are connected. The pressure switching unit 145 includes a second valve body part 148 that is provided in the second container 146, that causes a connection part of the low-pressure connection pipe 132 to communicate with the inside of the second valve body part 148 at all times, and that is slid in a slidable range to cause one of a connection part of a first communication flow passage 147*a* communicating with the first pressure chamber 134 and a connection part of a second communication flow passage 147*b* communicating with the second pressure chamber 135 to communicate with the inside of the second valve body part 148.

The pressure switching unit 145 includes a driving part 149 that slides the second valve body part 148. The driving part 149 includes an electromagnet 150, a plunger 151 that is attracted to the electromagnet 150 when the electromagnet 150 is energized, and a spring 152 that is repelled against the direction in which the plunger 151 is attracted. A brace 153 is provided between the second valve body part 148 and the plunger 151. With electricity supplied to the electromagnet 150, the electromagnet 150 attracts the plunger 151 so as to draw the second valve body part 148 toward the electromagnet 150. The spring 152 is provided around the electromagnet 150 and can elastically repel the plunger 151 such that the second valve body part 148 is moved away from the electromagnet 150.

The pressure switching unit 145 includes the first communication flow passage 147*a* that communicates with the first pressure chamber 134 and the second communication flow passage 147*b* that communicates with the second pressure chamber 135.

As illustrated in FIG. 2, when electricity is supplied to the electromagnet 150 of the pressure switching unit 145 by the controller 60, the second valve body part 148 is attracted towards the electromagnet 150, against a repulsive force of the spring 152. Thus, the connection part of the low-pressure connection pipe 132 communicates with the connection part of the second communication flow passage 147*b*, which communicates with the second pressure chamber 135, in the second valve body part 148. At this time, the connection part of the high-pressure connection pipe 131 communicates with the connection part of the first communication flow passage 147*a*, which communicates with the first pressure chamber 134, in a region located outside the second valve body part 148.

In contrast, when no electricity is supplied to the electromagnet 150 of the pressure switching unit 145 by the controller 60, the second valve body part 148 is moved away from the electromagnet 150 by the repulsive force of the spring 152. Thus, the connection part of the low-pressure connection pipe 132 communicates with the connection part of the first communication flow passage 147*a*, which communicates with the first pressure chamber 134, in the second valve body part 148. At this time, the connection part of the high-pressure connection pipe 131 communicates with the connection part of the second communication flow passage 147*b*, which communicates with the second pressure chamber 135, in a region located outside the second valve body part 148.

In either of the two states described above, the high-pressure refrigerant flows inside the second container 146 of the pressure switching unit 145 and outside the second valve body part 148, whereby the second valve body part 148 is pushed against the inner wall of the second container 146, and the high-pressure refrigerant is prevented from flowing into the second valve body part 148 in which low-pressure refrigerant flows.

Modification 1

Figure 3:
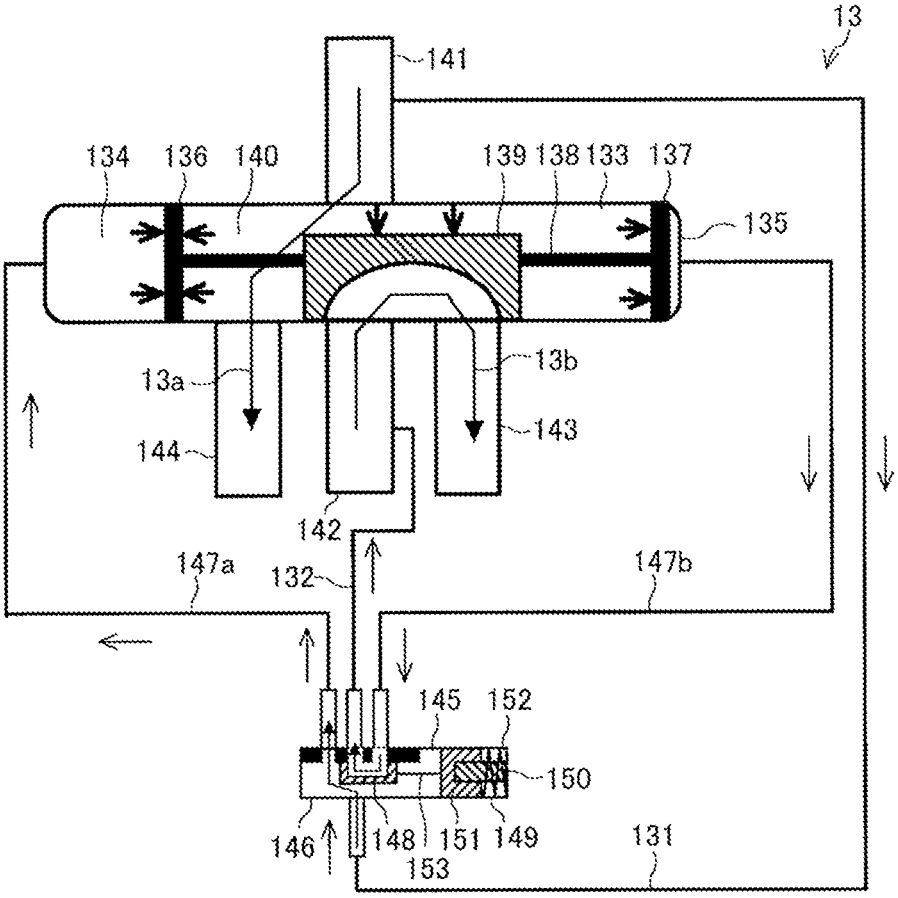
FIG. 3 is schematic configuration diagram illustrating a first flow switching device in modification 1 of Embodiment 1 in the cooling only operation mode.

FIG. 3 is a schematic configuration diagram illustrating the first flow switching device 13 in Modification 1 of Embodiment 1 in the cooling only operation mode. Regarding Modification 1, matters that are the same as those in Embodiment 1 will not be repeatedly described, and only features of Modification 1 will be described.

As illustrated in FIG. 3, the high-pressure connection pipe 131 in the first flow switching device 13 is connected with the atmosphere of high-pressure refrigerant in the switching pipe 141 that is connected to the inlet sides of the first flow passage 13*a* and the third flow passage 13*c* of the first flow switching device 13. The low-pressure connection pipe 132 in the first flow switching device 13 is connected with the atmosphere of low-pressure refrigerant in the switching pipe 142 that is connected to the inlet sides of the second flow passage 13*b* and the fourth flow passage 13*d* of the first flow switching device 13.

In the above case, the pressure of one of the first pressure chamber 134 and the second pressure chamber 135 that are connected to the high-pressure connection pipe 131 is equal to the pressure of the space 140 between the first partitioning part 136 and the second partitioning part 137 in the first container 133. For example, in the cooling only operation mode as illustrated in FIG. 3, the first pressure chamber 134 and the space 140 apply the same pressure to the first partitioning part 136, as indicated by arrows in the figure. Thus, a pushing force of the refrigerant in the first pressure chamber 134 that is applied to push the space 140 towards the second pressure chamber 135 does not work. However, the second pressure chamber 135 is connected to the low-pressure connection pipe 132 through the second communication flow passage 147*b*, the pressure of the high-pressure refrigerant is applied from the space 140 to the second pressure chamber 135, as indicated by arrows in the figure, and the size of the second pressure chamber 135 is thus reduced. Thus, the first flow switching device 13 can perform a differential pressure operation. Also, in the case where the size of the first pressure chamber 134 is reduced in the heating only operation mode and the heating main operation mode, a similar principle works.

Regarding Modification 1, the first flow switching device 13 is described as an example. The second flow switching device 14 may have a similar configuration to that of the first flow switching device 13. In the following, the configuration of the first flow switching device 13 as illustrated in FIG. 3 is described as the configuration of the second flow switching device 14. The high-pressure connection pipe 131 in the second flow switching device 14 is connected with the atmosphere of high-pressure refrigerant in the switching pipe 141 that is connected to the inlet sides of the first flow passage 14*a* and the third flow passage 14*c* of the second flow switching device 14. The low-pressure connection pipe 132 in the second flow switching device 14 is connected with the atmosphere of low-pressure refrigerant in the switching pipe 143 that is connected to the inlet sides of the second flow passage 14*b* and the fourth flow passage 14*d* of the second flow switching device 14.

<Operation Mode>

Operation modes of the air-conditioning apparatus 100 are roughly classified into a cooling operation mode and a heating operation mode. The cooling operation mode includes a cooling only operation mode and a cooling main operation mode. The cooling only operation mode is an operation mode in which one or ones of the indoor units 2*a* to 2*d* that are not in a stopped state all perform the cooling operation. That is, in the cooling only operation mode, one or ones of the load-side heat exchangers 26*a* to 26*d* that are not in the stopped state all operate as evaporators. The cooling main operation mode is a cooling and heating mixed operation mode in which one or more of the indoor units 2*a* to 2*d* perform the cooling operation, a remaining one or ones of the indoor units 2*a* to 2*d* perform the heating operation, and a cooling load is higher than a heating load. That is, in the cooling main operation mode, one or more of the load-side heat exchangers 26*a* to 26*d* operate as an evaporator and a remaining one or ones of the load-side heat exchangers 26*a* to 26*d* operate as a condenser.

The heating operation mode includes a heating only operation mode and a heating main operation mode. The heating only operation mode is an operation mode in which all the indoor units 2*a* to 2*d* that are not in the stopped state perform the heating operation. That is, in the heating only operation mode, one or ones of the load-side heat exchangers 26*a* to 26*d* that are not in the stopped state all operate as condensers. The heating main operation mode is a cooling and heating mixed operation mode in which one or more of the indoor units 2*a* to 2*d* perform the cooling operation, a remaining one or ones of the indoor units 2*a* to 2*d* perform the heating operation, and the heating load is higher than the cooling load. That is, in the cooling main operation mode, one or more of the load-side heat exchangers 26*a* to 26*d* operate as an evaporator and a remaining one or ones of the load-side heat exchangers 26*a* to 26*d* operate as a condenser.

<Cooling Only Operation Mode>

In FIG. 1, the flow direction of the refrigerant is indicated by solid arrows. It is assumed that a cooling energy load is applied only to the load-side heat exchanger 26*a* and the load-side heat exchanger 26*b*. In the cooling only operation mode, the controller 60 performs switching between flow passages in each of the first flow switching device 13 and the second flow switching device 14 of the outdoor unit 1, whereby refrigerant discharged from the compressor 10 flows into the heat-source-side heat exchanger 12.

Specifically, in the cooling only operation mode, the first flow passages 13*a* and 14*a* and the second flow passages 13*b* and 14*b* of the first flow switching device 13 and the second flow switching device 14 are switched to be opened. Furthermore, the third flow passages 13*c* and 14*c* and the fourth flow passages 13*d* and 14*d* of the first flow switching device 13 and the second flow switching device 14 are switched to be closed. As a result, the refrigerant discharged from the compressor 10 flows through the first flow passage 13*a* of the first flow switching device 13 and the heat-source-side heat exchanger 12 in this order, then flows through the first flow passage 14*a* of the second flow switching device 14, the second flow passage 13*b* of the first flow switching device 13, and the outflow pipe 5*b* in this order, and flows into the relay unit 3.

The refrigerant that has flowed out of the relay unit 3 flows through the inflow pipe 5*a*, then flows through the second flow passage 14*b* of the second flow switching device 14 and the accumulator 19, and flows into the compressor 10.

As illustrated in FIG. 2, the controller 60 causes the second valve body part 148 to be attracted towards the electromagnet 150 against to the repulsive force of the spring 152, by electricity supplied to the electromagnet 150 in the pressure switching unit 145 in each of the first flow switching device 13 and the second flow switching device 14. Thus, high-pressure refrigerant in the high-pressure connection pipe 131 passes through the first communication flow passage 147*a* and flows into the first pressure chamber 134. The pilot four-way flow switching valve in each of the first flow switching device 13 and the second flow switching device 14 slides the first valve body part 139 to reduce the size of the second pressure chamber 135 by causing refrigerant in the second pressure chamber 135 to flow through the second communication flow passage 147*b* and the low-pressure connection pipe 132. Thus, in the first valve body parts 139, the switching pipes 142 on the inlet sides of the second flow passages 13*b* and 14*b* and the fourth flow passages 13*d* and 14*d* and the switching pipes 143 on the outlet side of the second flow passages 13*b* and 14*b* communicate with each other, and the second flow passages 13*b* and 14*b* are provided. Accordingly, in the space 140 between the first partitioning part 136 and the second partitioning part 137 in the first containers 133, the switching pipes 141 on the inlet sides of the first flow passages 13*a* and 14*a* and the third flow passages 13*c* and 14*c* and the switching pipes 144 on the outlet side of the first flow passages 13*a* and 14*a* communicate with each other, and the first flow passages 13*a* and 14*a* are provided.

As illustrated in FIG. 1, low-temperature and low-pressure refrigerant is compressed by the compressor 10 to change into high-temperature and high-pressure gas refrigerant, and the high-temperature and high-pressure gas refrigerant is discharged. The high-temperature and high-pressure gas refrigerant discharged from the compressor 10 passes through the first flow passage 13*a* of the first flow switching device 13 and flows into the heat-source-side heat exchanger 12. The refrigerant that has flowed into the heat-source-side heat exchanger 12 transfers heat to outdoor air to change into high-pressure liquid refrigerant. After flowing out of the heat-source-side heat exchanger 12, the high-pressure liquid refrigerant passes through the first flow passage 14*a* of the second flow switching device 14 and the second flow passage 13*b* of the first flow switching device 13, and then flows out of the outdoor unit 1. The high-pressure liquid refrigerant that has flowed out of the outdoor unit 1 flows into the relay unit 3 through the outflow pipe 5*b*.

The high-pressure liquid refrigerant that has flowed into the relay unit 3 passes through the gas-liquid separator 29 and the first relay expansion device 30. Most of the high-pressure liquid refrigerant passes through the first backflow prevention devices 21*a* and 21*b* and the branch pipe 8*b*, and is expanded at the load-side expansion devices 25*a* and 25*b* to change into low-temperature and low-pressure two-phase gas-liquid refrigerant.

The two-phase gas-liquid refrigerant obtained after expanded at the load-side expansion devices 25*a* and 25*b* flows into the load-side heat exchangers 26*a* and 26*b* that operate as evaporators, and receives heat from indoor air to change into low-temperature and low-pressure gas refrigerant while cooling the indoor air. At this time, the opening degree of the load-side expansion device 25*a* is controlled such that the degree of superheat obtained as a difference between a temperature detected by the inlet-side temperature sensor 31*a* and a temperature detected by the outlet-side temperature sensor 32*a* is constant. Similarly, the opening degree of the load-side expansion device 25*b* is controlled such that the degree of superheat obtained as a difference between a temperature detected by the inlet-side temperature sensor 31*b* and a temperature detected by the outlet-side temperature sensor 32*b* is constant.

The gas refrigerant that has flowed out of the load-side heat exchangers 26*a* and 26*b* passes through the branch pipe 8*a* and the second opening and closing devices 24*a* and 24*b*, and then flows out of the relay unit 3. The refrigerant that has flowed out of the relay unit 3 passes through the inflow pipe 5*a*, and flows into the outdoor unit 1 again. The refrigerant that has flowed into the outdoor unit 1 passes through the second flow passage 14*b* of the second flow switching device 14, passes through the accumulator 19, and is re-sucked into the compressor 10.

In the case where a thermal load is not generated in the load-side heat exchangers 26*c* and 26*d*, tit is not necessary to cause refrigerant to flow into the load-side heat exchangers 26*c* and 26*d*. Thus, the load-side expansion devices 25*c* and 25*d*, which are associate with the load-side heat exchangers 26*c* and 26*d*, respectively, are closed. In the case where a cooling energy load is generated in the load-side heat exchanger 26*c* or the load-side heat exchanger 26*d*, the load-side expansion device 25*c* or the load-side expansion device 25*d* is opened to cause refrigerant to be circulated. At this time, the opening degree of the load-side expansion device 25*c* or the load-side expansion device 25*d* is controlled in a similar manner to that of the control of the load-side expansion device 25*a* or the load-side expansion device 25*b*. At this time, the degree of superheat obtained as a difference between a temperature detected by the inlet-side temperature sensor 31*c* or 31*d* and a temperature detected by the outlet-side temperature sensor 32*c* or 32*d* is made constant.

<Cooling Main Operation Mode>

Figure 4:
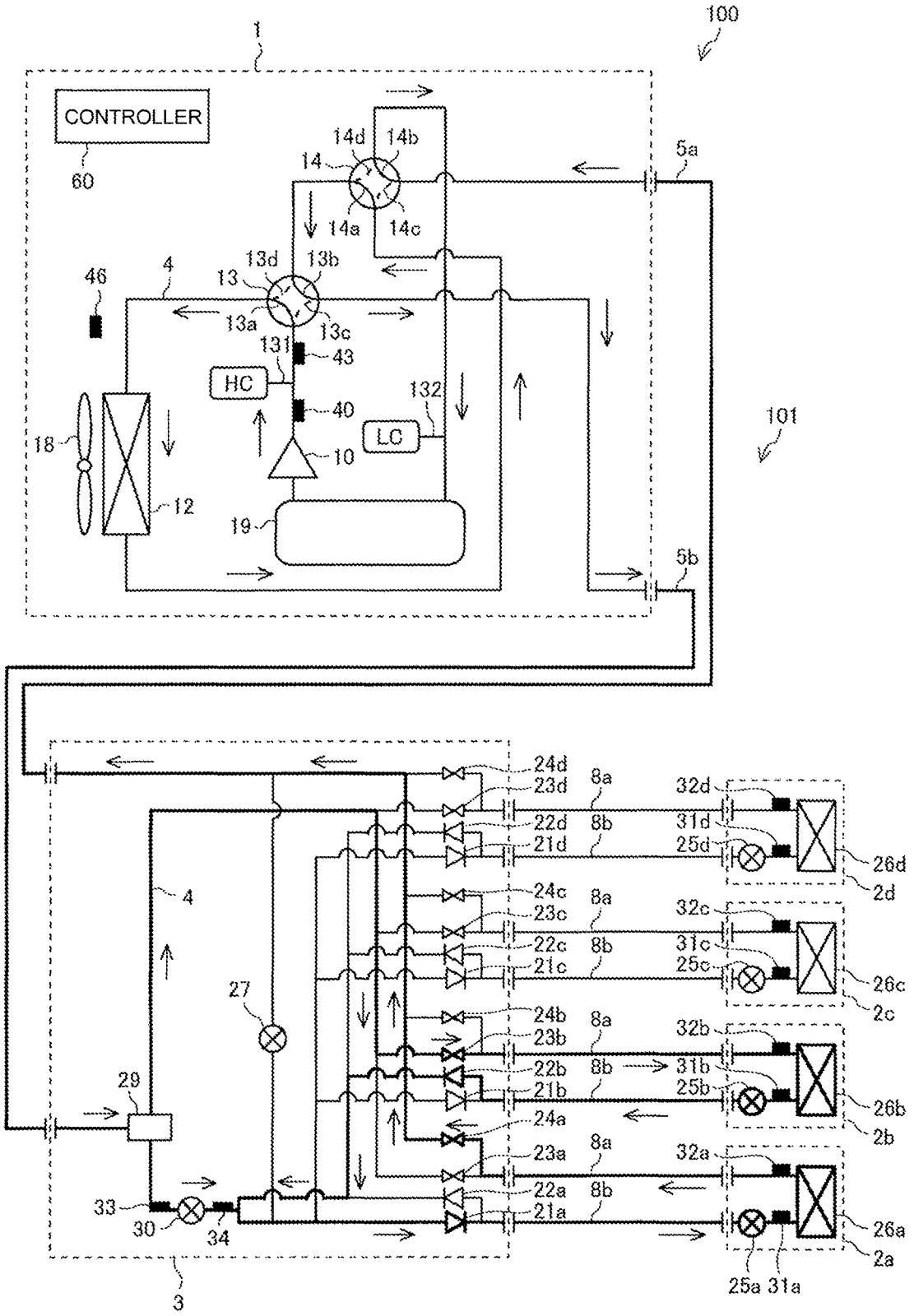
FIG. 4 is a refrigerant circuit diagram illustrating the air-conditioning apparatus according to Embodiment 1 in a cooling main operation mode.

FIG. 4 is a refrigerant circuit diagram illustrating the air-conditioning apparatus 100 according to Embodiment 1 in the cooling main operation mode. In FIG. 4, the flow direction of refrigerant is indicated by solid arrows. It is assumed that a cooling energy load is applied only to the load-side heat exchanger 26*a*, and a heating energy load is applied only to the load-side heat exchanger 26*b*. In the cooling main operation mode, the controller 60 performs switching between flow passages in each of the first flow switching device 13 and the second flow switching device 14 such that refrigerant discharged from the compressor 10 flows into the heat-source-side heat exchanger 12, as in the cooling only operation mode. After the above change, the states of the flow passages in the first flow switching device 13 and the second flow switching device 14 are the same as those of the first flow switching device 13 and the second flow switching device 14 in the cooling only operation mode.

That is, low-temperature and low-pressure refrigerant is compressed by the compressor 10 to change into high-temperature and high-pressure gas refrigerant, and the high-temperature and high-pressure gas refrigerant is discharged. The high-temperature and high-pressure gas refrigerant discharged from the compressor 10 passes through the first flow passage 13*a* of the first flow switching device 13 and flows into the heat-source-side heat exchanger 12. Then, the refrigerant that has flowed into the heat-source-side heat exchanger 12 transfers heat to outdoor air to change into two-phase gas-liquid refrigerant. After flowing out of the heat-source-side heat exchanger 12, the two-phase gas-liquid refrigerant flows through the second flow passage 13*b* of the first flow switching device 13 and the first flow passage 14*a* of the second flow switching device 14, and then flows into the relay unit 3 through the outflow pipe 5*b*.

The two-phase gas-liquid refrigerant that has flowed into the relay unit 3 is separated into high-pressure gas refrigerant and high-pressure liquid refrigerant by the gas-liquid separator 29. The high-pressure gas refrigerant passes through the first opening and closing device 23*b* and the branch pipe 8*a*, and then flows into the load-side heat exchanger 26*b* that operates as a condenser. The high-pressure gas refrigerant transfers heat to indoor air and thus changes into liquid refrigerant while heating the indoor air. At this time, the opening degree of the load-side expansion device 25*b* is controlled such that the degree of subcooling obtained as a difference between a value obtained by converting a pressure detected by the first relay-expansion-device inlet-side pressure sensor 33 into a saturation temperature and a temperature detected by the inlet-side temperature sensor 31*b* is constant. The liquid refrigerant that has flowed out of the load-side heat exchanger 26*b* is expanded by the load-side expansion device 25*b*, and flows through the branch pipe 8*b* and the second backflow prevention device 22*b*.

Thereafter, medium-pressure liquid refrigerant that is obtained through the above separation by the gas-liquid separator 29 and expansion by the first relay expansion device 30 joins the liquid refrigerant that has passed through the second backflow prevention device 22*b*. At this time, the opening degree of the first relay expansion device 30 is controlled such that the pressure difference between a pressure detected by the first relay-expansion-device inlet-side pressure sensor 33 and a pressure detected by the first relay-expansion-device outlet-side pressure sensor 34 is equal to a predetermined pressure difference (for example, 0.3 MPa).

Liquid refrigerant obtained by the above joining passes through the first backflow prevention device 21*a* and the branch pipe 8*b*, and is expanded at the load-side expansion device 25*a* to change into low-temperature and low-pressure two-phase gas-liquid refrigerant.

The two-phase gas-liquid refrigerant obtained through expansion by the load-side expansion device 25*a* of the indoor unit 2*a* flows into the load-side heat exchanger 26*a* that operates as an evaporator, and receives heat from indoor air to change into low-temperature and low-pressure gas refrigerant while cooling the indoor air. At this time, the opening degree of the load-side expansion device 25*a* is controlled such that the degree of superheat obtained as a difference between a temperature detected by the inlet-side temperature sensor 31*a* and a temperature detected by the outlet-side temperature sensor 32*b* is constant. After flowing out of the load-side heat exchanger 26*a*, the gas refrigerant passes through the branch pipe 8*a* and the second opening and closing device 24*a*, and then flows out of the relay unit 3. The refrigerant that has flowed out of the relay unit 3 re-flows into the outdoor unit 1 through the inflow pipe 5*a*. The refrigerant that has flowed into the outdoor unit 1 passes through the second flow passage 14*b* of the second flow switching device 14, then passes through the accumulator 19, and is re-sucked into the compressor 10.

In the case where a thermal load is not applied to the load-side heat exchangers 26*c* and 26*d*, it is not necessary to cause refrigerant to the load-side heat exchangers 26*c* and 26*d*. Thus, the load-side expansion devices 25*c* and 25*d*, which are associated with the load-side heat exchangers 26*c* and 26*d*, respectively, are closed. By contrast, in the case where a cooling energy load is applied to the load-side heat exchanger 26*c* or the load-side heat exchanger 26*d*, the load-side expansion device 25*c* or the load-side expansion device 25*d* is opened to cause refrigerant to be circulated. At this time, the opening degree of the load-side expansion device 25*c* or the load-side expansion device 25*d* is controlled such that the degree of superheat is constant, in a similar manner to that to the control of the load-side expansion device 25*a* or the load-side expansion device 25*b*. The degree of superheat corresponds to the difference between a temperature detected by the inlet-side temperature sensor 31*c* or 31*d* and a temperature detected by the outlet-side temperature sensor 32*c* or 32*d*.

<Heating Only Operation Mode>

Figure 5:
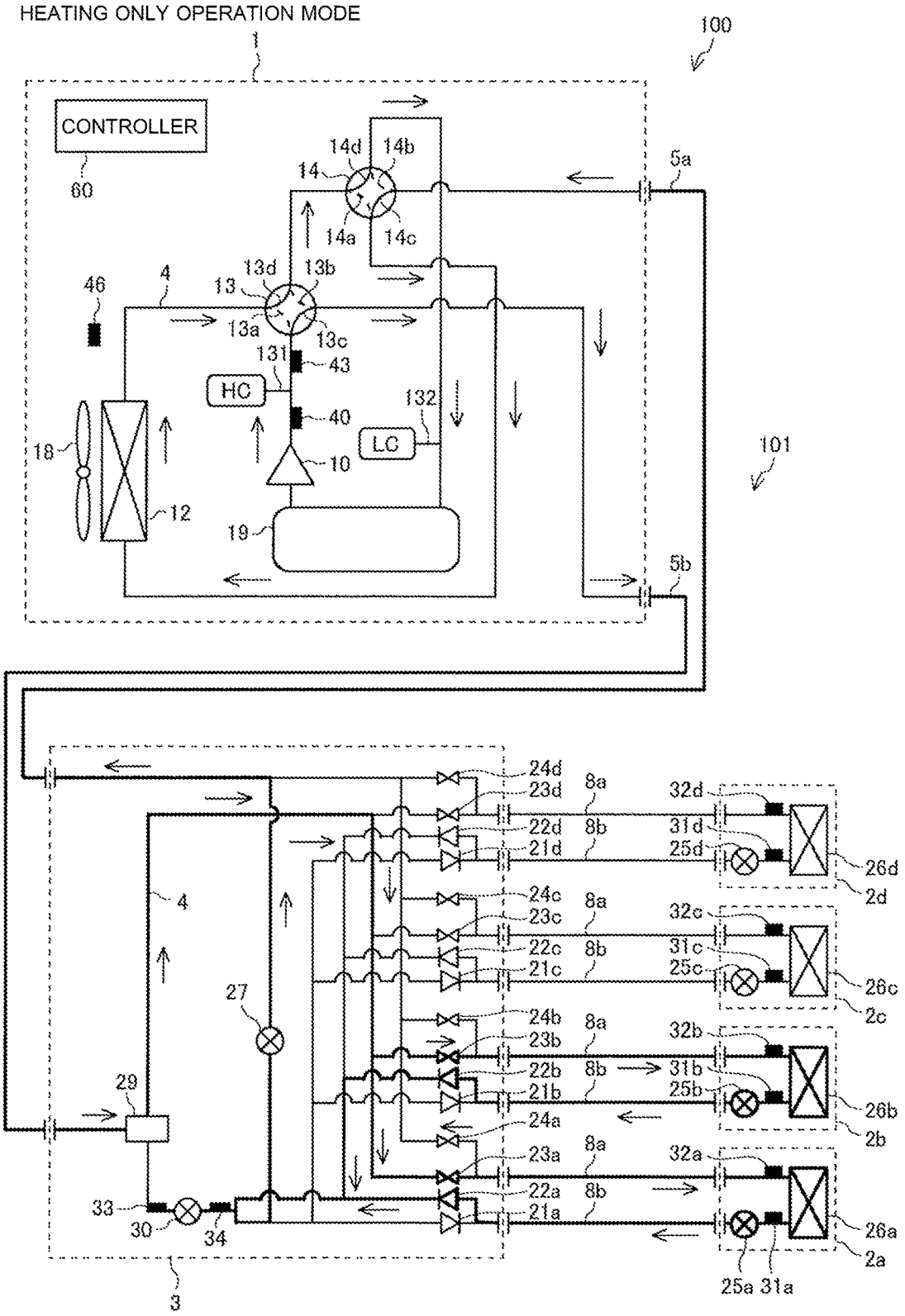
FIG. 5 is a refrigerant circuit diagram illustrating the air-conditioning apparatus according to Embodiment 1 in a heating only mode.

FIG. 5 is a refrigerant circuit diagram illustrating the air-conditioning apparatus 100 according to Embodiment 1 in the heating only mode. In FIG. 5, the flow direction of the refrigerant is indicated by solid arrows. It is assumed that a heating energy load is applied only to the load-side heat exchanger 26*a* and the load-side heat exchanger 26*b*. In the heating only operation mode, the controller 60 performs switching between flow passages in each of the first flow switching device 13 and the second flow switching device 14 to cause refrigerant discharged from the compressor 10 to flow into the relay unit 3 without passing through the heat-source-side heat exchanger 12.

Specifically, in the heating only operation mode, the third flow passages 13*c* and 14*c* and the fourth flow passages 13*d* and 14*d* of the first flow switching device 13 and the second flow switching device 14 are switched to be opened. Furthermore, the first flow passages 13*a* and 14*a* and the second flow passages 13*b* and 14*b* of the first flow switching device 13 and the second flow switching device 14 are switched to be closed. As a result, the refrigerant discharged from the compressor 10 flows through the third flow passage 13*c* of the first flow switching device 13, and then flows into the relay unit 3 through the outflow pipe 5*b*.

After flowing out of the relay unit 3, the refrigerant flows through the inflow pipe 5*a*, flows through the third flow passage 14*c* of the second flow switching device 14, the heat source side heat exchanger 12, the fourth flow passage 13*d* of the first flow switching device 13, the fourth flow passage 14*d* of the second flow switching device 14, and the accumulator 19 in this order, and then flows into the compressor 10.

Figure 6:
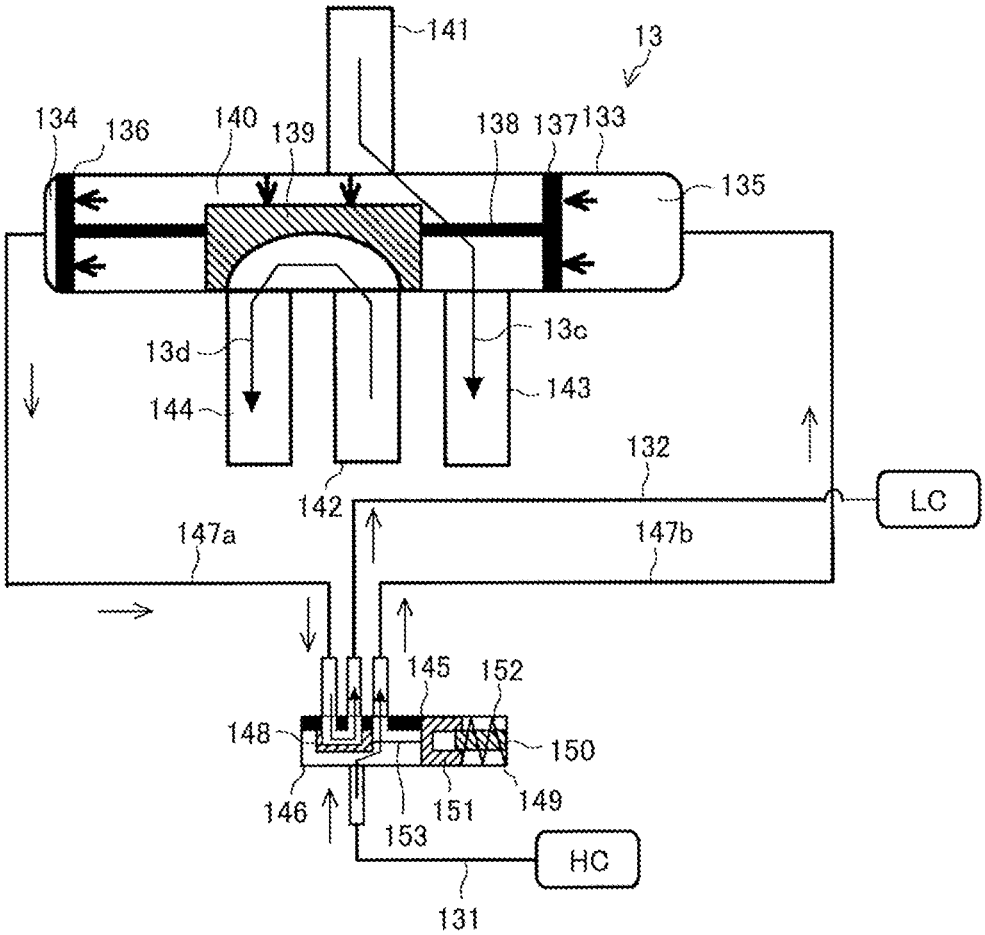
FIG. 6 is a schematic configuration diagram illustrating the first flow switching device in Embodiment 1 in a heating only operation mode.

FIG. 6 is a schematic configuration diagram illustrating the first flow switching device 13 according to Embodiment 1 in the heating only operation mode. As illustrated in FIG. 6, the controller 60 stops supply of electric power to the electromagnet 150 to cause the second valve body part 148 to be moved away from the electromagnet 150 by the repulsive force of the spring 152, that is, to prevent the second valve body part 148 from being attracted towards the electromagnet 150, in the pressure switching unit 145 of each of the first flow switching device 13 and the second flow switching device 14. As a result, high-pressure refrigerant in the high-pressure connection pipe 131 passes through the second communication flow passage 147*b*, and flows into the second pressure chamber 135. The pilot four-way flow switching valve in each of the first flow switching device 13 and the second flow switching device 14 slides the first valve body part 139 to cause the refrigerant in the first pressure chamber 134 to flow through the first communication flow passage 147*a* and the low-pressure connection pipe 132, thereby reducing the size of the first pressure chamber 134. Thus, the switching pipes 142 on the inlet sides of the second flow passages 13*b* and 14*b* and the fourth flow passages 13*d* and 14*d* and the switching pipes 144 on the outlet sides of the fourth flow passages 13*d* and 14*d* communicate with each other in the first valve body part 139, and the fourth flow passages 13*d* and 14*d* are thus provided. Accordingly, in the spaces 140 between the first partitioning parts 136 and the second partitioning parts 137 in the first containers 133, the switching pipes 141 on the inlet sides of the first flow passages 13*a* and 14*a* and the third flow passages 13*c* and 14*c* communicate with the switching pipes 143 on the outlet sides of the third flow passages 13*c* and 14*c*, respectively, and the third flow passages 13*c* and 14*c* are thus provided.

As illustrated in FIG. 5, low-temperature and low-pressure refrigerant is compressed by the compressor 10 to change into high-temperature and high-pressure gas refrigerant, and the high-temperature and high-pressure gas refrigerant is discharged. The high-temperature and high-pressure gas refrigerant discharged from the compressor 10 passes through the third flow passage 13*c* of the first flow switching device 13, and flows out of the outdoor unit 1. The high-temperature and high-pressure gas refrigerant that has flowed out of the outdoor unit 1 passes through the outflow pipe 5*b*, and flows into the relay unit 3.

The high-temperature and high-pressure gas refrigerant that has flowed into the relay unit 3 passes through the gas-liquid separator 29, the first opening and closing devices 23*a* and 23*b*, and the branch pipe 8*a*, and then flows into the load-side heat exchangers 26*a* and 26*b* that operate as condensers. The refrigerant that has flowed into the load-side heat exchangers 26*a* and 26*b* transfer heat to indoor air to change into liquid refrigerant while heating the indoor air. After flowing out of the load-side heat exchangers 26*a* and 26*b*, the liquid refrigerant is expanded at the load-side expansion devices 25*a* and 25*b*. The expanded refrigerant passes through the branch pipe 8*b*, the second backflow prevention devices 22*a* and 22*b*, the second relay expansion device 27 that is made to be opened, and the inflow pipe 5*a*, and then re-flows into the outdoor unit 1. At this time, the opening degree of the load-side expansion device 25*a* is controlled such that the degree of subcooling obtained as a difference between a value obtained by converting a pressure detected by the first relay-expansion-device inlet-side pressure sensor 33 into a saturation temperature and a temperature detected by the inlet-side temperature sensor 31*a* is constant. Similarly, the opening degree of the load-side expansion device 25*b* is controlled such that the degree of subcooling obtained as a difference between the value obtained by converting the pressure detected by the first relay-expansion-device inlet-side pressure sensor 33 into saturation temperature and a temperature detected by the inlet-side temperature sensor 31*b* is constant.

The refrigerant that has flowed into the outdoor unit 1 passes through the third flow passage 14*c* of the second flow switching device 14, and receives heat from outdoor air at the heat-source-side heat exchanger 12 to change into low-temperature and low-pressure gas refrigerant. The low-temperature and low-pressure gas refrigerant passes through the fourth flow passage 13*d* of the first flow switching device 13, the fourth flow passage 14*d* of the second flow switching device 14, and the accumulator 19, and is re-sucked into the compressor 10.

In the case where a thermal load is not generated in the load-side heat exchangers 26*c* and 26*d*, it is not necessary to cause refrigerant to flow into the load-side heat exchangers 26*c* and 26*d*. Thus, the load-side expansion devices 25*c* and 25*d*, which are associated with the load-side heat exchangers 26*c* and 26*d*, respectively, are closed. By contrast, in the case where a cooling energy load is generated in the load-side heat exchanger 26*c* or the load-side heat exchanger 26*d*, the load-side expansion device 25*c* or the load-side expansion device 25*d* is opened to cause refrigerant to be circulated. At this time, the opening degree of the load-side expansion device 25*c* or the load-side expansion device 25*d* is controlled such that the degree of subcooling obtained as a difference between a value obtained by converting a pressure detected by the pressure sensor 33 into a saturation temperature and a temperature detected by the inlet-side temperature sensor 31*c* or 31*d* is constant, in a similar manner to that of the control of the load-side expansion device 25*a* or the load-side expansion device 25*b*.

<Heating Main Operation Mode>

Figure 7:
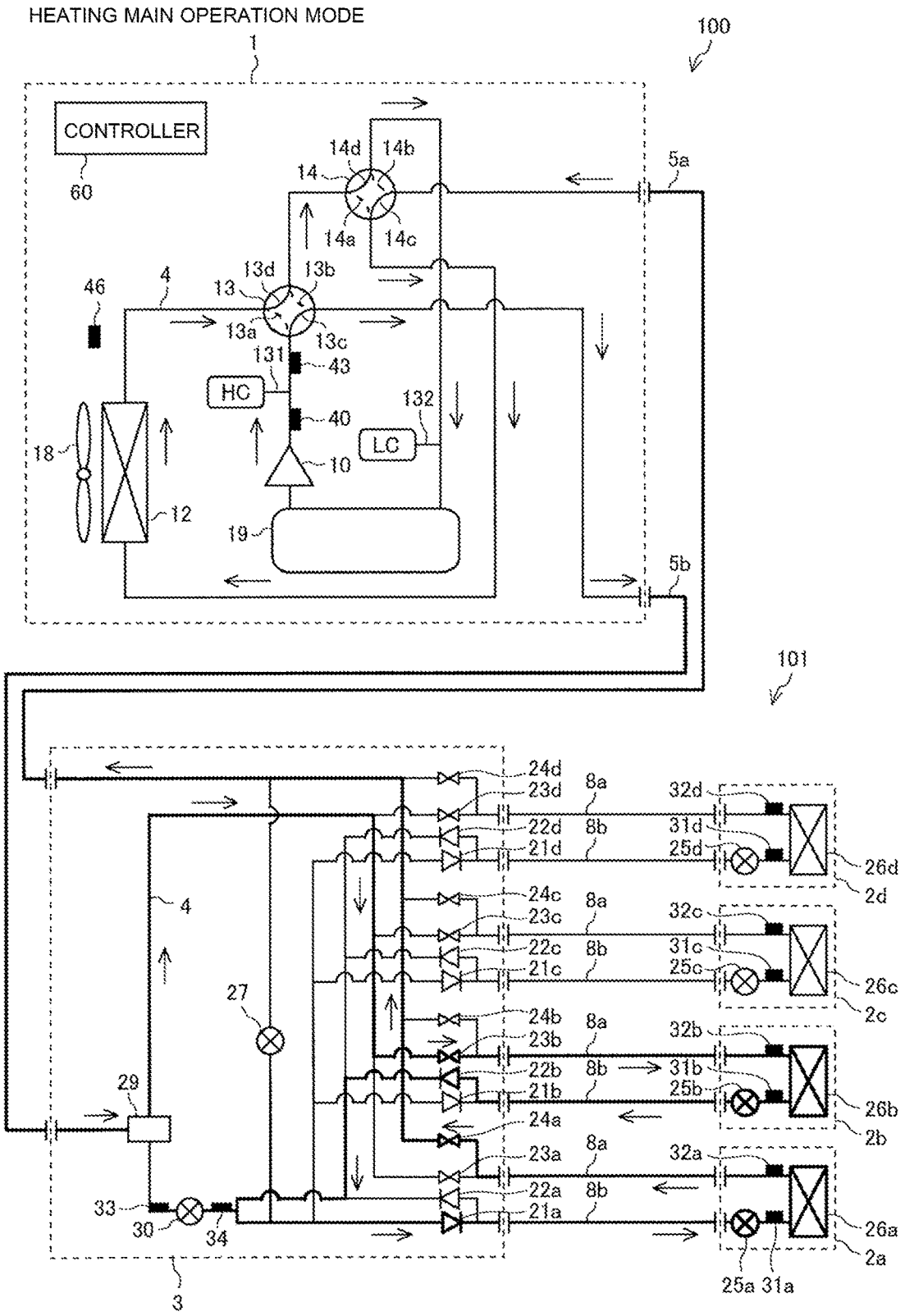
FIG. 7 is a refrigerant circuit diagram illustrating the air-conditioning apparatus according to Embodiment 1 in a heating main operation mode.

FIG. 7 is a refrigerant circuit diagram illustrating the air-conditioning apparatus 100 according to Embodiment 1 in the heating main operation mode. In FIG. 7, the flow direction of the refrigerant is indicated by solid arrows. It is assumed that a cooling energy load is applied only to the load-side heat exchanger 26*a*, and a heating energy load is applied only to the load-side heat exchanger 26*b*. In the heating main operation mode, the controller 60 performs switching between flow passages in each of the first flow switching device 13 and the second flow switching device 14 to cause heat source side refrigerant discharged from the compressor 10 to flow into the relay unit 3 without passing through the heat-source-side heat exchanger 12, as in the heating only mode.

Low-temperature and low-pressure refrigerant is compressed by the compressor 10 to change into high-temperature and high-pressure gas refrigerant, and the high-temperature and high-pressure gas refrigerant is discharged. The high-temperature and high-pressure gas refrigerant discharged from the compressor 10 passes through the third flow passage 13*c* of the first flow switching device 13, and then flows out of the outdoor unit 1. The high-temperature and high-pressure gas refrigerant that has flowed out of the outdoor unit 1 passes through the outflow pipe 5*b*, and flows into the relay unit 3.

The high-temperature and high-pressure gas refrigerant that has flowed into the relay unit 3 passes through the gas-liquid separator 29, the first opening and closing device 23*b*, and the branch pipe 8*a*, and then flows into the load-side heat exchanger 26*b* that operates as a condenser. The refrigerant that has flowed into the load-side heat exchanger 26*b* transfers heat to indoor air to change into liquid refrigerant while heating the indoor air. After flowing out of the load-side heat exchanger 26*b*, the liquid refrigerant is expanded at the load-side expansion device 25*b*, and passes through the branch pipe 8*b* and the second backflow prevention device 22*b*. After that, most of the refrigerant passes through the first backflow prevention device 21*a* and the branch pipe 8*b*, and is expanded at the load-side expansion device 25*a* to change into low-temperature and low-pressure two-phase gas-liquid refrigerant. A remaining part of the liquid refrigerant is expanded at the second relay expansion device 27, which is also used as a bypass, to change into medium-temperature and medium-pressure liquid refrigerant or two-phase gas-liquid refrigerant. The liquid refrigerant or the two-phase gas-liquid refrigerant flows into a low-pressure pipe on the outlet side of the relay unit 3.

The two-phase gas-liquid refrigerant obtained through expansion by the load-side expansion device 25*a* flows into the load-side heat exchanger 26*a* that operates as an evaporator, and receives heat from indoor air to change into low-temperature and medium-pressure two-phase gas-liquid refrigerant while cooling the indoor air. After flowing out of the load-side heat exchanger 26*a*, the two-phase gas-liquid refrigerant passes through the branch pipe 8*a* and the second opening and closing device 24*a*, and flows out of the relay unit 3. The refrigerant that has flowed out of the relay unit 3 passes through the inflow pipe 5*a*, and re-flows into the outdoor unit 1. The refrigerant that has flowed into the outdoor unit 1 passes through the third flow passage 14*c* of the second flow switching device 14, and receives heat from outdoor air at the heat-source-side heat exchanger 12 to change into low-temperature and low-pressure gas refrigerant. The gas refrigerant passes through the heat-source-side heat exchanger 12, the fourth flow passage 13*d* of the first flow switching device 13, the fourth flow passage 14*d* of the second flow switching device 14, and the accumulator 19 in this order, and is re-sucked into the compressor 10.

At this time, the opening degree of the load-side expansion device 25*b* is controlled such that the degree of subcooling obtained as a difference between a value obtained by converting a pressure detected by the first relay-expansion-device inlet-side pressure sensor 33 into a saturation temperature and a temperature detected by the inlet-side temperature sensor 31*b* is constant. In contrast, the opening degree of the load-side expansion device 25*a* is controlled such that the degree of superheat obtained as a difference between a temperature detected by the inlet-side temperature sensor 31*a* and a temperature detected by the outlet-side temperature sensor 32*a* is constant.

The opening degree of the second relay expansion device 27 is controlled such that the pressure difference between a pressure detected by the first relay-expansion-device inlet-side pressure sensor 33 and a pressure detected by the first relay-expansion-device outlet-side pressure sensor 34 is equal to a predetermined pressure difference (for example, 0.3 MPa).

It should be noted that in the case where a thermal load is not applied to the load-side heat exchangers 26*c* and 26*d*, it is not necessary to cause refrigerant to flow in the load-side heat exchangers 26*c* and 26*d*. Thus, the load-side expansion devices 25*c* and 25*d*, which are associated with the load-side heat exchangers 26*c* and 26*d*, respectively, are closed. In contrast, in the case where a thermal load is applied to the load-side heat exchanger 26*c* or the load-side heat exchanger 26*d*, the load-side expansion device 25*c* or the load-side expansion device 25*d* is opened to cause refrigerant to be circulated in the load-side expansion device 25*c* or the load-side expansion device 25*d*.

<Advantages of Embodiment 1]

According to Embodiment 1, the air-conditioning apparatus 100 includes the outdoor unit 1. The outdoor unit 1 includes the compressor 10 that compresses refrigerant and discharges the compressed refrigerant. The outdoor unit 1 includes the heat-source-side heat exchanger 12 that causes heat exchange to be performed between refrigerant and outside air. The air-conditioning apparatus 100 includes the relay unit 3. The relay unit 3 forms together with the outdoor unit 1, the refrigerant circuit 101. The outdoor unit 1 includes the first flow switching device 13 and the second flow switching device 14 each of which switches an associated flow passage for refrigerant between a plurality of flow passages, depending on which of the operation modes is set. The outflow pipe 5*b* that allows refrigerant to flow out of the outdoor unit 1 to the relay unit 3 and the inflow pipe 5*a* that allows refrigerant to flow from the relay unit 3 into the outdoor unit 1 are provided between the outdoor unit 1 and the relay unit 3. The compressor 10 and the first flow switching device 13 are connected to each other. The first flow switching device 13 and the second flow switching device 14 are connected to each other. The first flow switching device 13 and the outflow pipe 5*b* are connected to each other. The inflow pipe 5*a* and the second flow switching device 14 are connected to each other.

In the above configuration, the outflow pipe 5*b* and the inflow pipe 5*a* connect the outdoor unit 1 and the relay unit 3, and the flow direction of refrigerant in the outflow pipe 5*b* and the flow direction of refrigerant in the inflow pipe 5*a* are opposite to each other, and are each fixed to a single direction. Thus, a stable operation of the air-conditioning apparatus 100 can be achieved. Furthermore, the outdoor unit 1 includes the first flow switching device 13 and the second flow switching device 14 in place of check valves. Because a check valve that causes a pressure loss during the cooling operation is not provided, a pressure loss can be reduced, and deterioration of the cooling performance can be reduced. Therefore, the flow directions of refrigerant in the outflow pipe 5*b* and the inflow pipe 5*a*, which connect the outdoor unit 1 and the relay unit 3, are opposite to each other, and each necessarily fixed to a single direction, whereby a stable operation of the air-conditioning apparatus 100 can be achieved, and deterioration of the cooling performance can be reduced. In particular, a pressure loss, which would be caused at check valves on a low-pressure side of the exiting air-conditioning apparatus during a cooling operation, can be reduced, and the cooling performance can thus be improved. That is, during the cooling operation, low-pressure gas refrigerant that has flowed from the inflow pipe 5*a* into the outdoor unit 1 flows only through the second flow switching device 14 and the refrigerant pipe 4, whereby a pressure loss can be reduced, and the cooling performance can be improved. Furthermore, in the case where a plurality of check valves are provided as in the existing air-conditioning apparatus, arrangement of the refrigerant pipe 4 is complicated. However, in the embodiment, since no check valves are provided, setting of pipes is simplified, and a region in which the pipes are provided can be reduced.

According to Embodiment 1, the operation mode includes a cooling operation mode. In the cooling operation mode, refrigerant discharged from the compressor 10 flows through the first flow passage 13*a* of the first flow switching device 13 and the heat-source-side heat exchanger 12 in this order, then flows through the first flow passage 14*a* of the second flow switching device 14, the second flow passage 13*b* of the first flow switching device 13, and the outflow pipe 5*b* in this order, and flows into the relay unit 3. After flowing out of the relay unit 3, the refrigerant flows through the inflow pipe 5*a*, then flows through the second flow passage 14*b* of the second flow switching device 14, and flows into the compressor 10.

In the above configuration, in the outdoor unit 1, the first flow switching device 13 and the second flow switching device 14 can provide a flow passage for refrigerant in the cooling operation mode, in place of check valves.

According to Embodiment 1, the operation mode includes a cooling main operation mode in which a cooling and heating mixed operation is performed using the cooling operation mode.

In the above configuration, in the outdoor unit 1, each of the first flow switching device 13 and the second flow switching device 14 can provide a flow passage for refrigerant in the cooling main operation mode in which the cooling and heating mixed operation is performed using the cooling operation mode, in place of check valves.

According to Embodiment 1, the operation mode includes a heating operation mode. In the heating operation mode, refrigerant discharged from the compressor 10 flows through the third flow passage 13*c* of the first flow switching device 13, then flows through the outflow pipe 5*b*, and flows into the relay unit 3. After flowing out of the relay unit 3, the refrigerant flows through the inflow pipe 5*a*, then flows through the third flow passage 14*c* of the second flow switching device 14, the heat-source-side heat exchanger 12, the fourth flow passage 13*d* of the first flow switching device 13, and the fourth flow passage 14*d* of the second flow switching device 14 in this order, and flows into the compressor 10.

In the above configuration, in the outdoor unit 1, the first flow switching device 13 and the second flow switching device 14 can provide a flow passage for refrigerant in the heating operation mode, in place of check valves.

According to Embodiment 1, the operation mode includes a heating main operation mode in which the cooling and heating mixed operation is performed using the heating operation mode.

In the above configuration, in the outdoor unit 1, each of the first flow switching device 13 and the second flow switching device 14 can provide a flow passage for refrigerant in the heating main operation mode in which the cooling and heating mixed operation is performed using the heating operation mode, in place of check valves.

According to Embodiment 1, the first flow switching device 13 and the second flow switching device 14 are provided such that the first flow passages 13*a* and 14*a*, the second flow passages 13*b* and 14*b*, the third flow passages 13*c* and 14*c*, and the fourth flow passages 13*d* and 14*d* can be freely opened and closed. In the cooling operation mode, the first flow passages 13*a* and 14*a* and the second flow passages 13*b* and 14*b* are switched to be opened, and the third flow passages 13*c* and 14*c* and the fourth flow passages 13*d* and 14*d* are switched to be closed. In the heating operation mode, the third flow passages 13*c* and 14*c* and the fourth flow passages 13*d* and 14*d* are switched to be opened, and the first flow passages 13*a* and 14*a* and the second flow passages 13*b* and 14*b* are switched to be closed.

In the above configuration, in the outdoor unit 1, the first flow switching device 13 and the second flow switching device 14 can provide a flow passage for refrigerant for that can be switched between a flow passage for the cooling operation mode and a flow passage for the heating operation mode, in place of check valves.

According to Embodiment 1, at least one of the first flow switching device 13 and the second flow switching device 14 is a pilot four-way flow switching valve that switches a flow passage between a plurality of flow passages, based on a differential pressure.

In the above configuration, since the pilot four-way flow switching valve is driven by the differential pressure, the diameter of a flow passage of the refrigerant pipe 4 in the outdoor unit 1 can be increased. Thus, a large pilot four-way flow switching valve can be used. In contrast, in the case of adopting a direct-acting four-way flow switching valve, not the pilot four-way flow switching valve, in order to increase the diameter of a flow passage of the refrigerant pipe 4 in the outdoor unit 1, an electromagnetic coil that operates the direct-acting four-way flow switching valve needs to be made larger. Thus, the direct-acting four-way flow switching valve is made larger. Inevitably, the outdoor unit 1 is made larger. In contrast, in the case of adopting the pilot four-way flow switching valve, the configuration of the outdoor unit 1 can be simplified, thus reducing the cost.

According to Embodiment 1, the pilot four-way flow switching valve includes the high-pressure connection pipe 131 and the low-pressure connection pipe 132. The high-pressure connection pipe 131 is connected with the atmosphere of refrigerant whose pressure is higher than the pressure of the atmosphere of low-pressure refrigerant with which the low-pressure connection pipe 132 is connected.

In the above configuration, the pilot four-way flow switching valve can be driven by the differential pressure.

According to Embodiment 1, the pilot four-way flow switching valve includes the first pressure chamber 134 and the second pressure chamber 135 that are provided in the first container 133, and the pressure state of the first pressure chamber 134 and the pressure state of the second pressure chamber 135 are opposite to each other, since high-pressure refrigerant is connected with one of the first pressure chamber 134 and the second pressure chamber 135 by the low-pressure connection pipe 132, and low-pressure refrigerant is connected with the other of the first pressure chamber 134 and the second pressure chamber 135 by the high-pressure connection pipe 131. That is, when the first pressure chamber 134 is made in the high pressure state, the second pressure chamber 135 is made in the low pressure state, and when the first pressure chamber 134 is made in the low pressure state, the second pressure chamber 135 is made in the high pressure state. The pilot four-way flow switching valve includes the first partitioning part 136 and the second partitioning part 137 that are provided between the first pressure chamber 134 and the second pressure chamber 135 in the first container 133 such that spaces in the first pressure chamber 134 and the second pressure chamber 135 can be increased and decreased in an inversely correlated manner. The first partitioning part 136 partitions the first container 133 to define the first pressure chamber 134, and the second partitioning part 137 partitions the first container 133 to define the second pressure chamber 135. The pilot four-way flow switching valve has the space 140 between the first partitioning part 136 and the second partitioning part 137, and includes the coupling part 138 that couples the first partitioning part 136 and the second partitioning part 137 to each other. The pilot four-way flow switching valve includes the first valve body part 139 that is slidably provided in the middle of the coupling part 138 between the first pressure chamber 134 and the second pressure chamber 135 such that the distance between the first valve body part 139 and the first pressure chamber 134 and the distance between the first valve body part 139 and the second pressure chamber 135 can be increased and decreased in an inversely correlated manner. The four switching pipes 141, 142, 143, and 144 that define the first flow passages 13*a* and 14*a*, the second flow passages 13*b* and 14*b*, the third flow passages 13*c* and 14*c*, and the fourth flow passages 13*d* and 14*d* are connected with the space 140 between the first partitioning part 136 and the second partitioning part 137 of the first container 133. The three switching pipes 142, 143, and 144 of the four switching pipes 141, 142, 143, and 144 are provided in parallel in the slidable range of the first valve body part 139. The first valve body part 139 causes the switching pipe 142, which is connected to the inlet sides of the second flow passages 13*b* and 14*b* and the fourth flow passages 13*d* and 14*d*, to communicate with the inside of the first valve body part 139 at all times, and is slid in the slidable range to cause one of the switching pipes 143 and 144, which are connected to the outlet sides of the second flow passages 13*b* and 14*b* or the fourth flow passages 13*d* and 14*d*, to communicate with the inside of the first valve body part 139, in accordance with the pressures of refrigerant connected with the first pressure chamber 134 and the second pressure chamber 135. High-pressure refrigerant flows in the space 140 that is located between the switching pipe 141 connected to the inlet sides of the first flow passages 13*a* and 14*a* and the third flow passages 13*c* and 14*c* and located outside the first valve body part 139 and one of the switching pipes 144 and 143 that does not form one of the second flow passages 13*b* and 14*b* and the fourth flow passages 13*d* and 14*d*, the space 140 being also located between the first partitioning part 136 and the second partitioning part 137 in the first container 133.

In the above configuration, the pilot four-way flow switching valve can be driven by a differential pressure. The second flow passages 13*b* and 14*b* are opened at the same time as the first flow passages 13*a* and 14*a* are opened, and the fourth flow passages 13*d* and 14*d* are opened as the same time as the third flow passages 13*c* and 14*c* are opened.

According to Embodiment 1, the high-pressure connection pipe 131 is connected with the atmosphere of high-pressure refrigerant between the discharge side of the compressor 10 and the first flow switching device 13. The low-pressure connection pipe 132 is connected with the atmosphere of low-pressure refrigerant between the second flow switching device 14 and the suction side of the compressor 10.

In the above configuration, a differential pressure can be reliably ensured, and an intermediate stop of the pilot four-way flow switching valve can be prevented. Thus, a stable differential-pressure driving of the pilot four-way flow switching valve can be achieved, and switching between flow passages can be reliably performed.

According to Embodiment 1, the high-pressure connection pipe 131 in the first flow switching device 13 is connected with the atmosphere of high-pressure refrigerant in the switching pipe 141 that is connected to the inlet sides of the first flow passage 13*a* and the third flow passage 13*c* of the first flow switching device 13. The low-pressure connection pipe 132 in the first flow switching device 13 is connected with the atmosphere of low-pressure refrigerant in the switching pipe 142 that is connected to the inlet sides of the second flow passage 13*b* and the fourth flow passage 13*d* of the first flow switching device 13.

In the above configuration, the pilot four-way flow switching valve in the first flow switching device 13 can be configured as a single unit including the high-pressure connection pipe 131 and the low-pressure connection pipe 132 and can thus be easily handled.

According to Embodiment 1, the high-pressure connection pipe 131 in the second flow switching device 14 is connected with the atmosphere of high-pressure refrigerant in the switching pipe 141 that is connected to the inlet sides of the first flow passage 14*a* and the third flow passage 14*c* of the second flow switching device 14. The low-pressure connection pipe 132 in the second flow switching device 14 is connected with the atmosphere of low-pressure refrigerant in the switching pipe 142 that is connected to the inlet sides of the second flow passage 14*b* and the fourth flow passage 14*d* of the second flow switching device 14.

In the above configuration, the pilot four-way flow switching valve in the second flow switching device 14 can be configured as a single unit including the high-pressure connection pipe 131 and the low-pressure connection pipe 132, and can thus be easily handled.

According to Embodiment 1, the air-conditioning apparatus 100 includes the pressure switching unit 145 that switches refrigerant to flow in the pilot four-way flow switching valve between high-pressure refrigerant that flows through the high-pressure connection pipe 131 and low-pressure refrigerant that flows through the low-pressure connection pipe 132.

In the above configuration, the pilot four-way flow switching valve can be driven by a differential pressure using the high-pressure or low-pressure refrigerant that is applied by switching by the pressure switching unit 145.

According to Embodiment 1, the pressure switching unit 145 includes the second container 146 to which the high-pressure connection pipe 131 and the low-pressure connection pipe 132 are connected. The pressure switching unit 145 includes the second valve body part 148 that is provided in the second container 146, that causes a connection part of the low-pressure connection pipe 132 to communicate with the inside of the second valve body part 148 at all times, and that is slid in the slidable range to cause one of a connection part of the first communication flow passage 147*a* communicating with the first pressure chamber 134 and a connection part of the second communication flow passage 147*b* communicating with the second pressure chamber 135 to communicate with the inside of the second valve body part 148. The pressure switching unit 145 includes the driving part 149 that slides the second valve body part 148.

In the above configuration, the first pressure chamber 134 and the second pressure chamber 135 of the pilot four-way flow switching valves can be supplied with respective refrigerant having different pressures, that is, the high-pressure refrigerant is connected with one of the first pressure chamber 134 and the second pressure chamber 135, and low-pressure refrigerant is connected with the other of the first pressure chamber 134 and the second pressure chamber 135, and by switching by the pressure switching unit 145, when the first pressure chamber 134 is made in the high pressure state, the second pressure chamber 135 is made in the low pressure state, and when the first pressure chamber 134 is made in the low pressure state, the second pressure chamber 135 is made in the high pressure state, and the pilot four-way flow switching valve can be driven by the differential pressure.

According to Embodiment 1, the air-conditioning apparatus 100 includes one or more indoor units 2 that include respective load-side heat exchangers connected to the relay unit 3 by the refrigerant pipes 4 and that are included in the refrigerant circuit 101, for example, indoor units 2*a* to 2*d* that include the load-side heat exchangers 26*a* to 26*d* connected to the relay unit 3 by the refrigerant pipes 4 and that are included in the refrigerant circuit 101.

In the above configuration, the indoor units 2*a* to 2*d* are capable of performing cooling and heating using refrigerant that flows in the refrigerant circuit 101.

Embodiment 2

Figure 8:
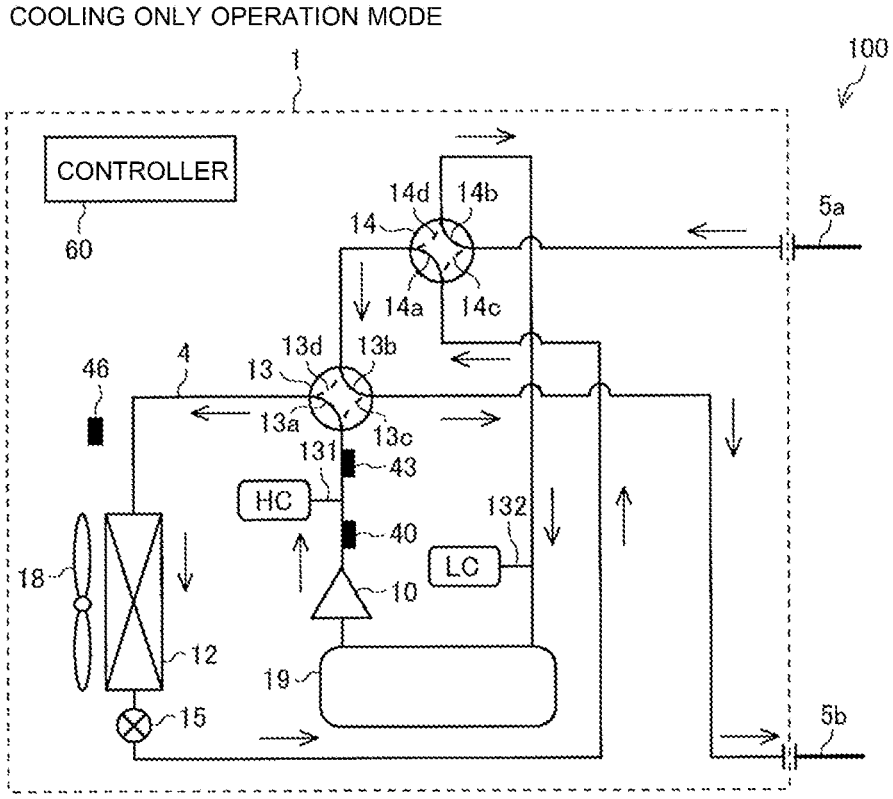
FIG. 8 is a refrigerant circuit diagram illustrating an outdoor unit of an air-conditioning apparatus according to Embodiment 2 in the cooling only operation mode.

FIG. 8 is a refrigerant circuit diagram illustrating the outdoor unit 1 of the air-conditioning apparatus 100 according to Embodiment 2 in the cooling only operation mode. Regarding Embodiment 2, after matters that are the same as those in Embodiment 1 will not be repeatedly described, and only features of Embodiment 2 will be described.

As illustrated in FIG. 8, the outdoor unit 1 includes an expansion device 15 that is provided downstream of the heat-source-side heat exchanger 12 in the case where the heat-source-side heat exchanger 12 is used as a condenser. The expansion device 15 is, for example, an electronic expansion valve.

In the cooling only operation mode and the cooling main operation mode, the opening degree of the expansion device 15 is adjusted such that the pressure of the first flow passage 13*a* in the first flow switching device 13 is higher than the pressure of the second flow passage 13*b* in the first flow switching device 13. Furthermore, in the heating only operation mode and the heating main operation mode, the opening degree of the expansion device 15 is adjusted such that the pressure of the third flow passage 14*c* is higher than the pressure of the fourth flow passage 14*d* in the second flow switching device 14.

Advantages of Embodiment 2

According to Embodiment 2, the air-conditioning apparatus 100 includes the expansion device 15 that is provided downstream of the heat-source-side heat exchanger 12 in the case where the heat-source-side heat exchanger 12 is used as a condenser.

In the above configuration, a differential pressure can be reliably ensured by the expansion device 15, and an intermediate stop of the pilot four-way flow switching valve can be prevented. Thus, the pilot four-way flow switching valve can be stably driven by the differential pressure, and switching between flow passages can be reliably performed.

According to Embodiment 2, in the cooling operation mode, the opening degree of the expansion device 15 is adjusted such that the pressure of the first flow passage 13*a* in the first flow switching device 13 is higher than the pressure of the second flow passage 13*b* in the first flow switching device 13. In the heating operation mode, the opening degree of the expansion device 15 is adjusted such that the pressure of the third flow passage 14*c* is higher than the pressure of the fourth flow passage 14*d* in the second flow switching device 14.

In the above configuration, the differential-pressure driving part of the pilot four-way flow switching valve is pushed by higher-pressure refrigerant, and leakage of high-pressure refrigerant to a low-pressure refrigerant side can be prevented in the pilot four-way flow switching valve. Thus, deterioration of the capacity and performance of the pilot four-way flow switching valve can be reduced.

Embodiment 3

Figure 9:
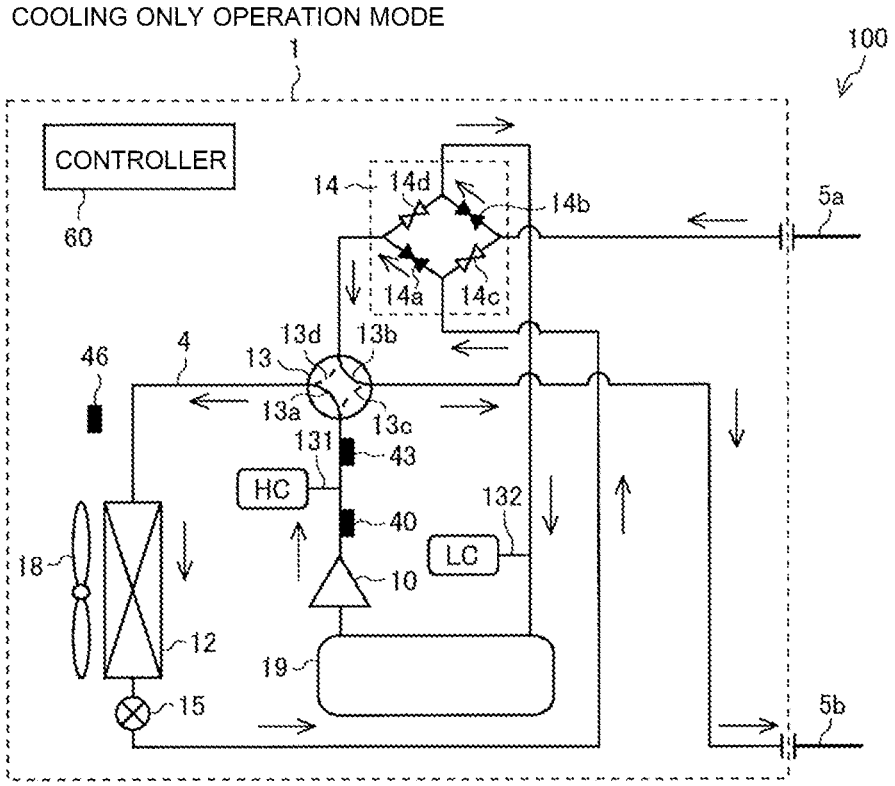
FIG. 9 is a refrigerant circuit diagram illustrating an outdoor unit of an air-conditioning apparatus according to Embodiment 3 in the cooling only operation mode.

FIG. 9 is a refrigerant circuit diagram illustrating the outdoor unit 1 of the air-conditioning apparatus 100 according to Embodiment 3 in the cooling only operation mode. Regarding Embodiment 3, matters that are the same as those in Embodiment 1 or Embodiment 2 will not be repeatedly described, and only features of Embodiment 3 will be described.

The second flow switching device 14 includes four opening and closing units that can open and close respective flow passages, that is, the first flow passage 14*a*, the second flow passage 14*b*, the third flow passage 14*c*, and the fourth flow passage 14*d*. In FIG. 9, opened flow passages in opening and closing units are blacked, and closed flow passages in opening and closing units are whitened. In the cooling only operation mode and the cooling main operation mode, the first flow passage 14*a* and the second flow passage 14*b* are opened by the respective opening and closing units, and the third flow passage 14*c* and the fourth flow passage 14*d* are closed by the respective opening and closing units. Furthermore, in the heating only operation mode and the heating main operation mode, the third flow passage 14*c* and the fourth flow passage 14*d* are opened by the respective opening and closing units, and the first flow passage 14*a* and the second flow passage 14*b* are closed by the respective opening and closing units.

Modification 2

Figure 10:
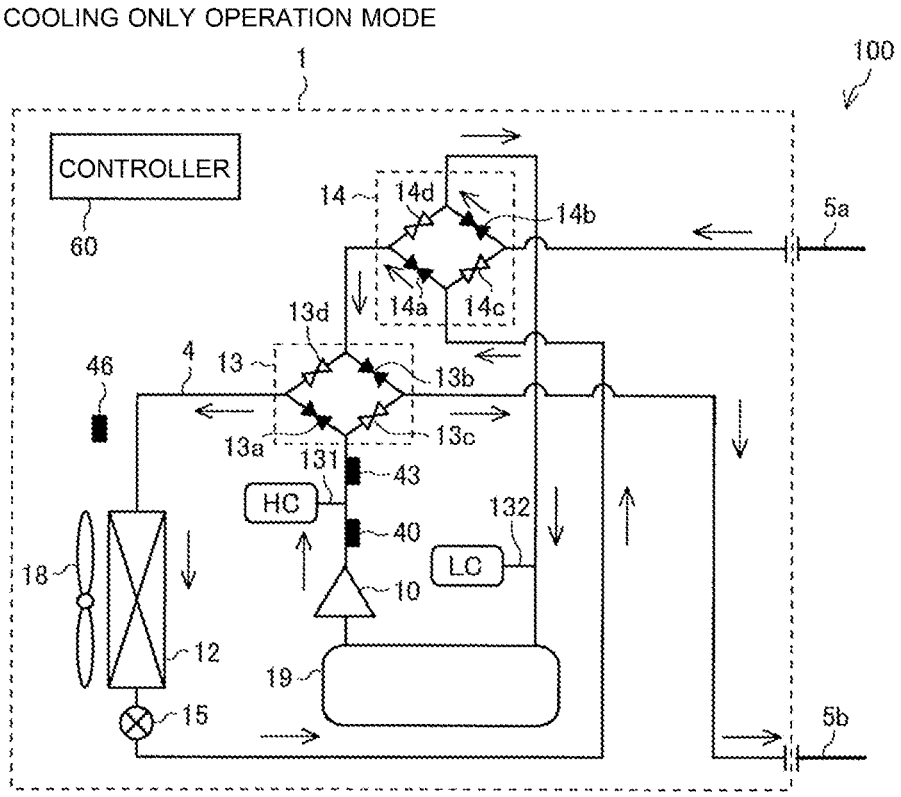
FIG. 10 is a refrigerant circuit diagram illustrating an outdoor unit of an air-conditioning apparatus according to modification 2 of Embodiment 3 in the cooling only operation mode.

FIG. 10 is a refrigerant circuit diagram illustrating the outdoor unit 1 of the air-conditioning apparatus 100 according to Modification 2 of Embodiment 3 in the cooling only operation mode. Regarding Modification 2, matters that are the same as those in Embodiment 1, Embodiment 2, or Embodiment 3 will not be repeatedly described, and only features of Modification 2 will be described.

The first flow switching device 13 includes four opening and closing units that can open and close respective flow passages, that is, the first flow passage 13*a*, the second flow passage 13*b*, the third flow passage 13*c*, and the fourth flow passage 13*d*. In FIG. 10, opened flow passages in opening and closing units are blacked, and closed flow passages in opening and closing units are whitened. In the cooling only operation mode and the cooling main operation mode, the first flow passage 13*a* and the second flow passage 13*b* are opened by the respective opening and closing units, and the third flow passage 13*c* and the fourth flow passage 13*d* are closed by the respective opening and closing units. Furthermore, in the heating only operation mode and the heating main operation mode, the third flow passage 13*c* and the fourth flow passage 13*d* are opened by the respective opening and closing units, and the first flow passage 13*a* and the second flow passage 13*b* are closed by the respective opening and closing units.

Others

In Embodiment 3 and Modification 2, the second flow switching device 14 includes four opening and closing units that can open and close respective flow passages, that is, the first flow passage 14*a*, the second flow passage 14*b*, the third flow passage 14*c*, and the fourth flow passage 14*d*. However, the first flow switching device 13 and the second flow switching device 14 are not necessarily configured as described above. At least one of the first flow switching device 13 and the second flow switching device 14 may include four opening and closing units that can open and close respective flow passages, that is, the first flow passage 13*a* or 14*a*, the second flow passage 13*b* or 14*b*, the third flow passage 13*c* or 14*c*, and the fourth flow passage 13*d* or 14*d*.

Advantages of Embodiment 3

According to Embodiment 3, at least one of the first flow switching device 13 and the second flow switching device 14 includes four opening and closing units that can open and close respective flow passages, that is, the first flow passage 13*a* or 14*a*, the second flow passage 13*b* or 14*b*, the third flow passage 13*c* or 14*c*, and the fourth flow passage 13*d* or 14*d*.

In the above configuration, in the case where the refrigerant flow in the outflow pipe 5*b* and the inflow pipe 5*a* that connect the outdoor unit 1 and the relay unit 3, the refrigerant in the outflow pipe 5*b* and the refrigerant in the inflow pipe 5*a* flows in the opposite directions such that the flow direction of the refrigerant in each of the outflow pipe 5*b* and the inflow pipe 5*a* is necessarily fixed to a single direction, whereby it is possible to reduce deterioration of the cooling performance, while achieving a stable operation of the air-conditioning apparatus 100.

Embodiment 4

Figure 11:
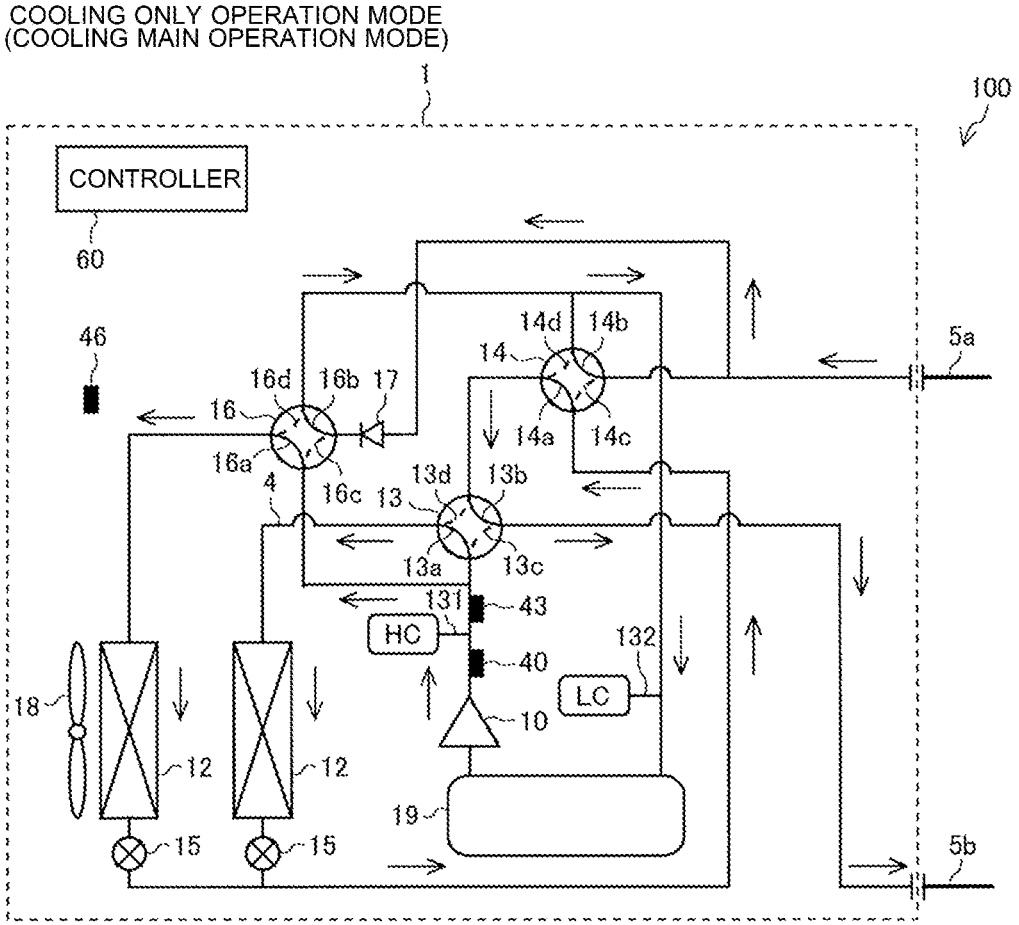
FIG. 11 is a refrigerant circuit diagram illustrating an outdoor unit of an air-conditioning apparatus according to Embodiment 4 in the cooling only operation mode.

FIG. 11 is a refrigerant circuit diagram illustrating the outdoor unit 1 of the air-conditioning apparatus 100 according to Embodiment 4 in the cooling only operation mode. Regarding Embodiment 4, matters that are the same as those in Embodiment 1, Embodiment 2, or Embodiment 3 will not be repeatedly described, and only features of Embodiment 4 will be described.

As illustrated in FIG. 11, the outdoor unit 1 includes two heat-source-side heat exchangers 12 that are arranged in parallel. The outdoor unit 1 includes a third flow switching device 16. One of the heat-source-side heat exchangers 12 is connected to the first flow switching device 13 by the refrigerant pipe 4, and the other heat-source-side heat exchanger 12 is connected to the third flow switching device 16 by the refrigerant pipe 4. In the cooling only operation mode and the cooling main operation mode, the third flow switching device 16 causes refrigerant to flow in parallel with the refrigerant that is caused to flow by the first flow switching device 13. A check valve 17 is provided at the refrigerant pipe 4 that is located between the inflow pipe 5*a* and the third flow switching device 16. Two expansion devices 15 are provided downstream of the heat-source-side heat exchangers 12 in the flow direction of refrigerant in the case where the heat-source-side heat exchangers 12 operate as condensers. The third flow switching device 16 is provided such that a first flow passage 16*a*, a second flow passage 16*b*, a third flow passage 16*c*, and a fourth flow passage 16*d* can be opened and closed. The third flow switching device 16 may be a pilot four-way flow switching valve.

<Cooling Only Operation Mode and Cooling Main Operation Mode>

In the cooling only operation mode and the cooling main operation mode, the first flow passages 13*a*, 14*a*, and 16*a* and the second flow passages 13*b*, 14*b*, and 16*b* of the first flow switching device 13, the second flow switching device 14, and the third flow switching device 16 are switched to be opened. Furthermore, the third flow passages 13*c*, 14*c*, and 16*c* and the fourth flow passages 13*d*, 14*d*, and 16*d* of the first flow switching device 13, the second flow switching device 14, and the third flow switching device 16 are switched to be closed. Thus, refrigerant discharged from the compressor 10 flows through the first flow passage 13*a* of the first flow switching device 13, the heat-source-side heat exchanger 12, and the expansion device 15 in this order, and flows through the first flow passage 16*a* of the third flow switching device 16, the heat-source-side heat exchanger 12, and the expansion device 15 in this order. After that, the refrigerant flows through the first flow passage 14*a* of the second flow switching device 14, the second flow passage 13*b* of the first flow switching device 13, and the outflow pipe 5*b* in this order, and flows into the relay unit 3. In the cooling operation mode and the cooling main operation mode, when at least one of the expansion devices 15 is adjusted to be closed, the amounts of condensation of refrigerant at the two heat-source-side heat exchangers 12 can be minutely adjusted.

<Enhanced-Heating Cooling Main Operation Mode>

Figure 12:
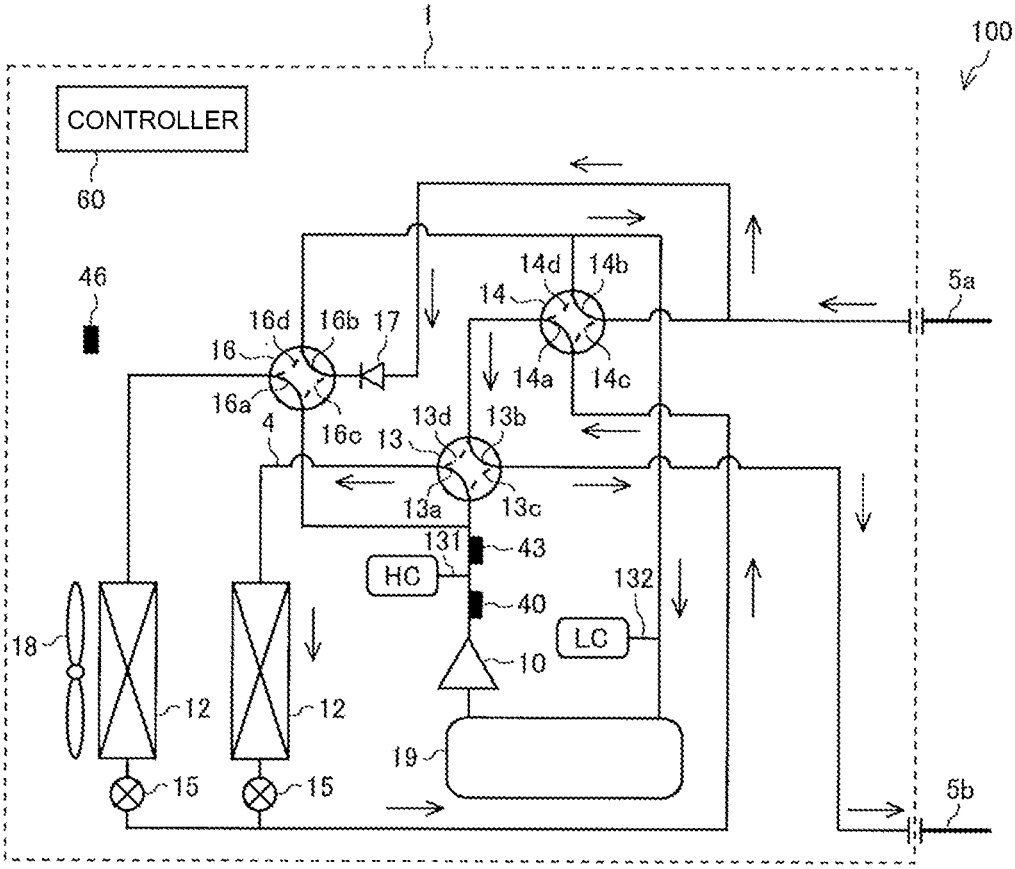
FIG. 12 is a refrigerant circuit diagram illustrating the outdoor unit of the air-conditioning apparatus according to Embodiment 4 in an enhanced-heating cooling main operation mode.

FIG. 12 is a refrigerant circuit diagram illustrating the outdoor unit 1 of the air-conditioning apparatus 100 according to Embodiment 4 in an enhanced-heating cooling main operation mode. As illustrated in FIG. 12, in the cooling main operation mode, when a heating load is high, the enhanced-heating cooling main mode is applied. In the enhanced-heating cooling main operation mode, the expansion device 15 that is located downstream of the third flow switching device 16 in the flow direction of refrigerant is closed. Thus, a condensation process in which the amount of condensation of refrigerant that flows through the first flow passage 13*a* of the first flow switching device 13 and the heat-source-side heat exchanger 12 in this order is small is achieved in the outdoor unit 1. As described above, the amount of refrigerant to be condensed is adjusted to be small, a high quality of refrigerant can be maintained, and heating energy of refrigerant that passes through the outflow pipe 5*b* and flows in the relay unit 3 can be ensured. Thus, the heating capacity during a cooling and heating mixed operation can be increased.

<Heating Only Operation Mode and Heating Main Operation Mode>

Figure 13:
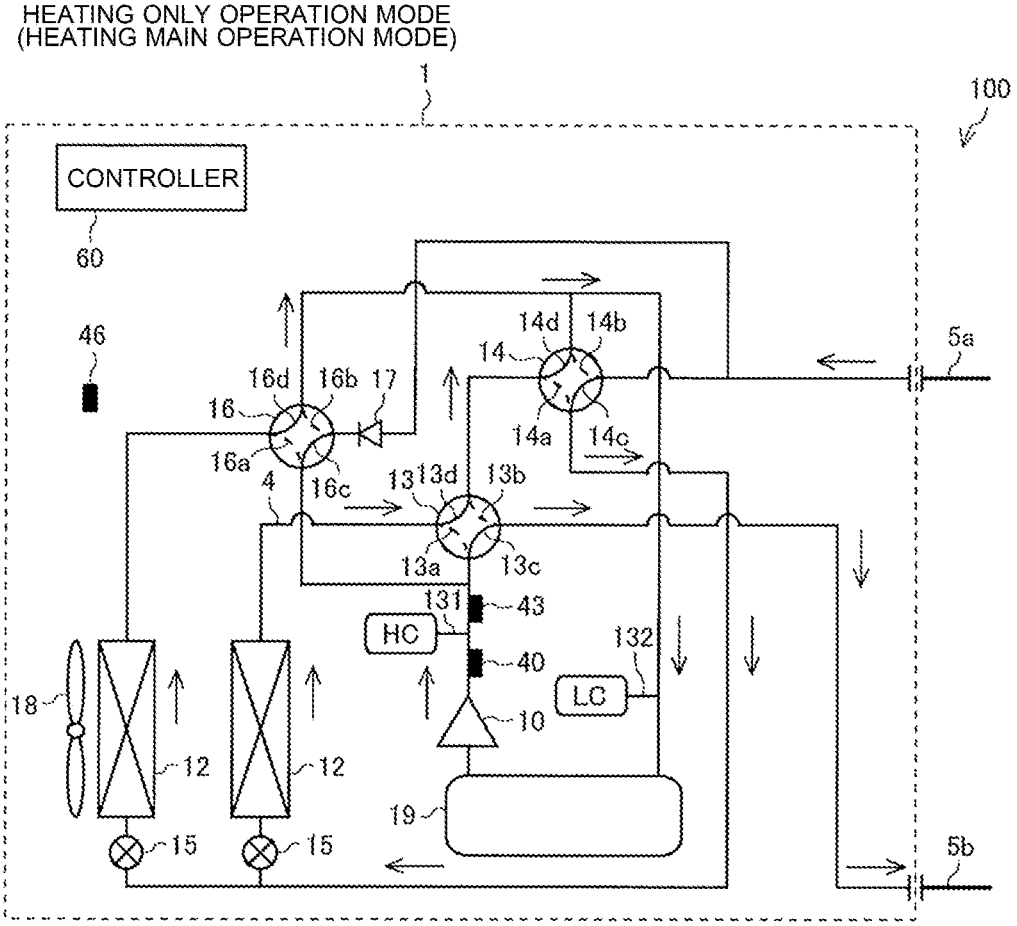
FIG. 13 is a refrigerant circuit diagram illustrating the outdoor unit of the air-conditioning apparatus according to Embodiment 4 in the heating only operation mode.

FIG. 13 is a refrigerant circuit diagram illustrating the outdoor unit 1 of the air-conditioning apparatus 100 according to Embodiment 4 in the heating only operation mode. As illustrated in FIG. 13, in the heating only operation mode and the heating main operation mode, the third flow passages 13*c*, 14*c*, and 16*c* and the fourth flow passages 13*d*, 14*d*, and 16*d* of the first flow switching device 13, the second flow switching device 14, and the third flow switching device 16 are switched to be opened. Furthermore, the first flow passages 13*a*, 14*a*, and 16*a* and the second flow passages 13*b*, 14*b*, and 16*b* of the first flow switching device 13, the second flow switching device 14, and the third flow switching device 16 are switched to be closed. Thus, refrigerant discharged from the compressor 10 flows through the third flow passage 13*c* of the first flow switching device 13, then flows through the outflow pipe 5*b*, and flows into the relay unit 3. Refrigerant that flows through the third flow passage 16*c* of the third flow switching device 16 is prevented by the check valve 17 from flowing into the inflow pipe 5*a*.

The refrigerant that has flowed out of the relay unit 3 flows through the inflow pipe 5*a*, flows through the third flow passage 14*c* of the second flow switching device 14, and branches off into refrigerant streams. One of the refrigerant streams flows through the expansion device 15, one of the heat-source-side heat exchangers 12, the fourth flow passage 13*d* of the first flow switching device 13, the fourth flow passage 14*d* of the second flow switching device 14, and the accumulator 19 in this order, and flows into the compressor 10. The other refrigerant streams flows through the expansion device 15, the other of the heat-source-side heat exchangers 12, and the fourth flow passage 16*d* of the third flow switching device 16 in this order, and joins the above one of the refrigerant streams in a region located upstream of the accumulator 19.

Advantages of Embodiment 4

According to Embodiment 4, the outdoor unit 1 includes two heat-source-side heat exchangers 12 that are provided in parallel. One of the heat-source-side heat exchangers 12 is connected to the first flow switching device 13 by the refrigerant pipe 4. The outdoor unit 1 includes the third flow switching device 16 that is connected to the other one of the heat-source-side heat exchangers 12 by the refrigerant pipe 4, and that causes refrigerant in the third flow switching device 16 to flow in parallel with refrigerant that is caused to flow by the first flow switching device 13. The outdoor unit 1 includes the check valve 17 provided at the refrigerant pipe 4 that is located between the inflow pipe 5*a* and the third flow switching device 16.

In the above configuration, during the cooling operation, refrigerant that flows in the outdoor unit 1 branches off to flow into the two heat-source-side heat exchangers 12 that are disposed in parallel. Thus, the heat exchange efficiency can be improved, and the pressure loss during the cooling operation can further be reduced. Furthermore, during the cooling main operation, in the case where a heating load is high, since the two heat-source-side heat exchangers 12 are disposed in parallel, the amounts of refrigerant to be condensed at the heat-source-side heat exchangers 12 can be easily adjusted, and a high quality can be easily maintained. Thus, heating energy can be ensured, and the heating capacity during the cooling and heating mixed operation can be improved.

Embodiment 5

Figure 14:
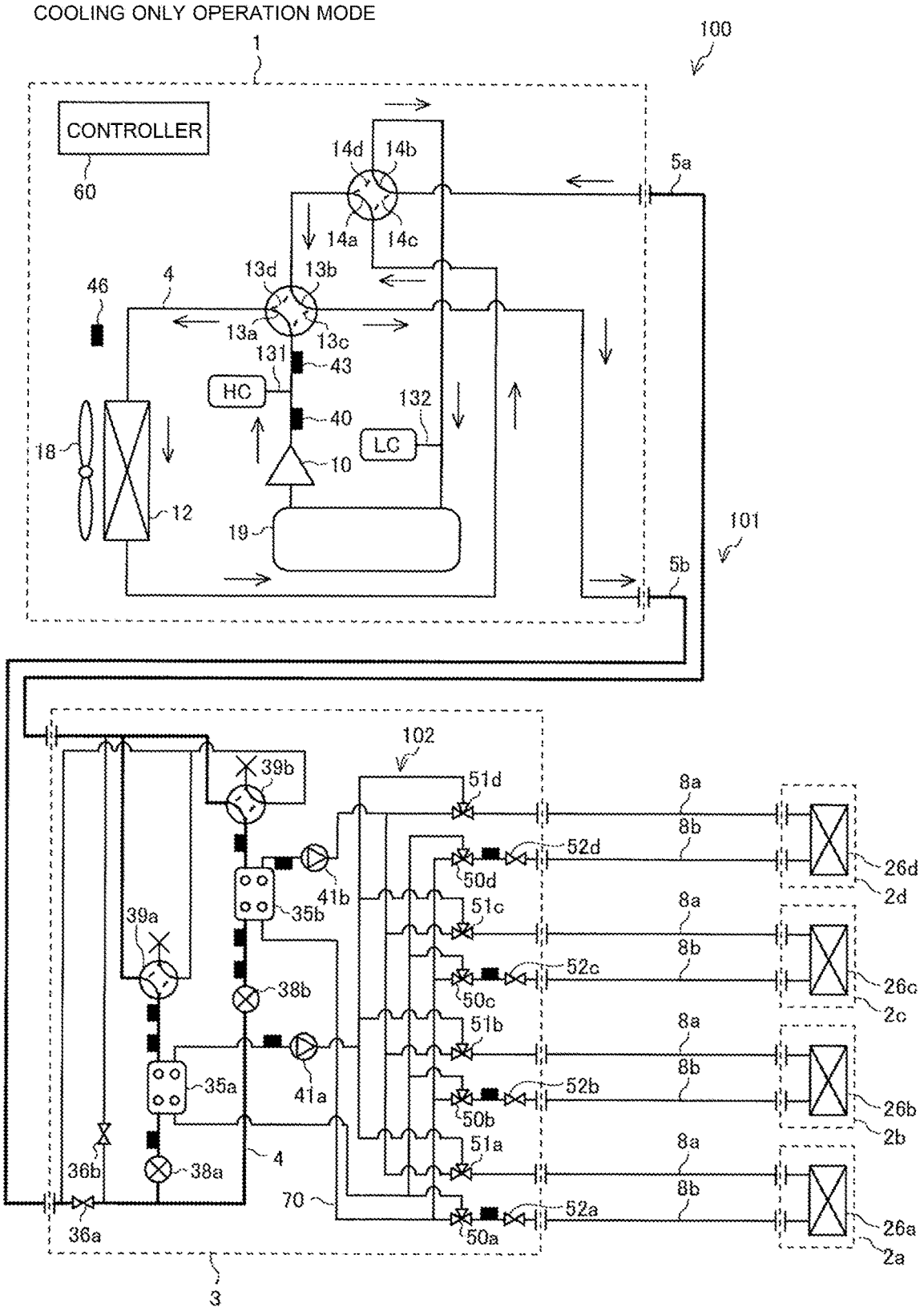
FIG. 14 is a refrigerant circuit diagram illustrating an air-conditioning apparatus according to Embodiment 5 in the cooling only operation mode.

FIG. 14 is a refrigerant circuit diagram illustrating the air-conditioning apparatus 100 according to Embodiment 5 in the cooling only operation mode. Regarding Embodiment 5, matters that are the same as those in Embodiment 1, Embodiment 2, Embodiment 3, or Embodiment 4 will not be repeatedly descried, and only features of Embodiment 5 will be described.

As illustrated in FIG. 14, the relay unit 3 includes relay heat exchangers 35*a* and 35*b* that cause heat exchange to be performed between refrigerant and a heat medium such as water or brine. The indoor units 2 include a plurality of load-side heat exchangers 26*a* to 26*d* that are connected to the relay heat exchangers 35*a* and 35*b* in the relay unit 3 by a heat medium pipe 70 in which a heat medium flows, and that are configured to form, together with the relay unit 3, a heat medium circuit 102.

The outdoor unit 1 and the relay unit 3 are connected to each other by the outflow pipe 5*b* and the inflow pipe 5*a* in which refrigerant flows through the relay heat exchangers 35*a* and 35*b* provided in the relay unit 3. The relay unit 3 and the indoor units 2 are connected to each other by the heat medium pipe 70 in which a heat medium flows through the relay heat exchangers 35*a* and 35*b*.

Relay Unit 3

The relay unit 3 includes the two relay heat exchangers 35*a* and 35*b*, two relay expansion devices 38*a* and 38*b*, two opening and closing devices 36*a* and 36*b*, and two relay flow switching devices 39*a* and 39*b*. The relay unit 3 includes two pumps 41*a* and 41*b*, four first heat-medium flow switching devices 50*a* to 50*d*, four second heat-medium flow switching devices 51*a* to 51*d*, and four heat-medium flow rate control devices 52*a* to 52*d*.

The relay heat exchangers 35*a* and 35*b* operate as condensers or evaporators. The relay heat exchangers 35*a* and 35*b* cause heat exchange to be performed between refrigerant and a heat medium, and transmits cooling energy or heating energy generated at the outdoor unit 1 and stored in the refrigerant to the heat medium. The relay heat exchanger 35*a* is provided between the relay expansion device 38*a* and the relay flow switching device 39*a* in the refrigerant circuit 101. The relay heat exchanger 35*a* is applied to heating of a heat medium during the cooling and heating mixed operation. Furthermore, the relay heat exchanger 35*b* is provided between the relay expansion device 38*b* and the relay flow switching device 39*b* in the refrigerant circuit 101. The relay heat exchanger 35*b* is applied to cooling of a heat medium during the cooling and heating mixed operation.

The relay expansion devices 38*a* and 38*b* each have a function of a pressure reducing valve or an expansion valve, and reduce the pressure of refrigerant to expand the refrigerant. The relay expansion device 38*a* is provided upstream of the relay heat exchanger 35*a* in the flow of refrigerant during the cooling operation. The relay expansion device 38*b* is provided upstream of the relay heat exchanger 35*b* in the flow of refrigerant during the cooling operation. The two relay expansion devices 38*a* and 38*b* are each, for example, an electronic expansion valve whose opening degree can be changed.

The opening and closing devices 36*a* and 36*b* are each, for example, a two-way valve, and open and close the refrigerant pipe 4. The opening and closing device 36*a* is provided at the refrigerant pipe 4 that is located on the inlet side for refrigerant. The opening and closing device 36*b* is provided at the refrigerant pipe 4 that connects the inlet side and the outlet side for refrigerant.

The relay flow switching devices 39*a* and 39*b* are each, for example, a four-way valve and perform switching between the flows of refrigerant, depending on which of the operation modes is set. The relay flow switching device 39*a* is provided downstream of the relay heat exchanger 35*a* in the flow of refrigerant during the cooling operation. The relay flow switching device 39*b* is provided downstream of the relay heat exchanger 35*b* in the flow of refrigerant during the cooling only operation.

The pumps 41*a* and 41*b* pressurize a heat medium connected to the heat medium pipe 70, thereby circulating the heat medium. The pump 41*a* is provided at the heat medium pipe 70 that is located between the relay heat exchanger 35*a* and the second heat-medium flow switching devices 51*a* to 51*d*. The pump 41*b* is provided at the heat medium pipe 70 that is located between the relay heat exchanger 35*b* and the second heat-medium flow switching devices 51*a* to 51*d*. The pumps 41*a* and 41*b* are each, for example, a pump whose capacity can be controlled.

The four first heat-medium flow switching devices 50*a* to 50*d* are each, for example, a three-way valve and each switch an associated flow passage for the heat medium between a plurality of flow passages. The number of the first heat-medium flow switching devices provided corresponds to the number of the indoor units 2 installed, and in an example illustrated in the figure, the first heat-medium flow switching devices 50*a* to 50*d* are provided. One of three ports of each of the first heat-medium flow switching devices 50*a* to 50*d* is connected to the relay heat exchanger 35*a*, another one of the three ports of each of the first heat-medium flow switching devices 50*a* to 50*d* is connected to the relay heat exchanger 35*b*, and the other of the three ports of each of the first heat-medium flow switching devices 50*a* to 50*d* is connected to the associated one of the heat-medium flow rate control devices 52*a* to 52*d*. The first heat-medium flow switching devices 50*a* to 50*d* are provided on the outlet sides of heat medium flow passages for the load-side heat exchangers 26*a* to 26*d*, respectively. In FIG. 14, in association with the indoor units 2, the first heat-medium flow switching devices 50*a*, 50*b*, 50*c*, and 50*d* are illustrated in this order from the lower side of the figure.

The four second heat-medium flow switching devices 51*a* to 51*d* are each, for example, a three-way valve and performs switching between flow passages for the heat medium. The number of the second heat-medium flow switching devices provided corresponds to the number of the indoor units 2 installed, and in the example illustrated in the figure, the second heat-medium flow switching devices 51*a* to 51*d* are provided. One of three ports of each of the second heat-medium flow switching devices 51*a* to 51*d* is connected to the relay heat exchanger 35*a*, another one of the three ports of each of the second heat-medium flow switching devices 51*a* to 51*d* is connected to the relay heat exchanger 35*b*, and the other of the three ports of each of the second heat-medium flow switching devices 51*a* to 51*d* is connected to the relay heat exchanger 35*b*, and the other of the three ports of each of the second heat-medium flow switching devices 51*a* to 51*d* is connected to an associated one of the load-side heat exchangers 26*a* to 26*d*. The second heat-medium flow switching devices 51*a* to 51*d* are provided on the inlet sides of heat medium flow passages for the load-side heat exchangers 26*a* to 26*d*, respectively. In association with the indoor units 2, the second heat-medium flow switching devices 51*a*, 51*b*, 51*c*, and 51*d* are illustrated in this order from the lower side of the figure.

The four heat-medium flow rate control devices 52*a* to 52*d* are each, for example, a two-way valve whose opening area can be controlled, and control the flow rate in the heat medium pipe 70. The number of the heat-medium flow rate control devices provided corresponds to the number of the indoor units 2 installed, and in the example illustrated in the figure, the heat-medium flow rate control devices 52*a* to 52*d* are provided. One of two ports of each of the heat-medium flow rate control devices 52*a* to 52*d* is connected to an associated one of the load-side heat exchangers 26*a* to 26*d*, and the other of the two ports of each of the heat-medium flow rate control devices 52*a* to 52*d* is connected to an associated one of the first heat-medium flow switching devices 50*a* to 50*d*. The heat-medium flow rate control devices 52*a* to 52*d* are provided on the outlet sides of heat medium flow passages for the load-side heat exchangers 26*a* to 26*d*, respectively. In association with the indoor units 2, the heat-medium flow rate control devices 52*a*, 52*b*, 52*c*, and 52*d* are illustrated in this order from the lower side of the figure. Furthermore, the heat-medium flow rate control devices 52*a* to 52*d* may be provided on the inlet sides of the heat medium flow passages for the load-side heat exchangers 26*a* to 26*d*, respectively.

Various sensors are provided at the relay unit 3. Signals related to detection by the sensors are transmitted to, for example, the controller 60.

<Configuration of Indoor Units 2*a* to 2*d*>

The indoor units 2*a* to 2*d* are included in the heat medium circuit 102. For example, the indoor units 2*a* to 2*d* have the same configuration. The indoor units 2*a* to 2*d* include the load-side heat exchangers 26*a* to 26*d*, respectively. The load-side heat exchangers 26*a* to 26*d* are connected to the relay unit 3 by the branch pipes 8*a* and 8*b*. At each of the load-side heat exchangers 26*a* to 26*d*, air supplied by a load-side fan not illustrated exchanges heat with a heat medium, whereby cooling air or heating air to be supplied to an indoor space is generated.

Operation Mode

Operation modes of the air-conditioning apparatus 100 include four operation modes as in the air-conditioning apparatus 100 as described above regarding Embodiment 1. Of the operation modes, a first operation mode is a cooling only operation mode in which one or ones of the indoor units 2, which are driven, are all allowed to perform the cooling operation; a second operation mode is a heating only operation mode in which one or ones of the indoor units 2, which are driven, are all allowed to perform the heating operation; a third operation mode is a cooling main operation mode that is applied as a cooling and heating mixed operation in the case where a cooling load is high; and a fourth operation mode is a heating main operation mode that is applied as a cooling and heating mixed operation in the case where a heating load is high.

Advantages of Embodiment 5

According to Embodiment 5, the relay unit 3 includes the relay heat exchangers 35*a* and 35*b* that cause heat exchange to be performed between refrigerant and a heat medium. The air-conditioning apparatus 100 includes one or more indoor units 2*a* to 2*d* that include the load-side heat exchangers 26*a* to 27*d* connected to the relay heat exchangers 35*a* and 35*b* in the relay unit 3 by the heat medium pipes 70 in which a heat medium flows, and that form, together with the relay unit 3, the heat medium circuit 102.

In the above configuration, the indoor units 2*a* to 2*d* are capable of performing cooling and heating using a heat medium that has exchanged heat with refrigerant in the refrigerant circuit 101 at the relay heat exchangers 35*a* and 35*b* of the relay unit 3. Embodiments 1 to 5 may be combined or may be applied to other parts.

REFERENCE SIGNS LIST

1: outdoor unit, 2: indoor unit, 2*a*: indoor unit, 2*b*: indoor unit, 2*c*: indoor unit, 2*d*: indoor unit, 3: relay unit, 4: refrigerant pipe, 5*a*: inflow pipe, 5*b*: outflow pipe, 8*a*: branch pipe, 8*b*: branch pipe, 10: compressor, 12: heat-source-side heat exchanger, 13: first flow switching device, 13*a*: first flow passage, 13*b*: second flow passage, 13*c*: third flow passage, 13*d*: fourth flow passage, 14: second flow switching device, 14*a*: first flow passage, 14*b*: second flow passage, 14*c*: third flow passage, 14*d*: fourth flow passage, 15: expansion device, 16: third flow switching device, 16*a*: first flow passage, 16*b*: second flow passage, 16*c*: third flow passage, 16*d*: fourth flow passage, 17: check valve, 18: heat-source-side fan, 19: accumulator, 21*a*: first backflow prevention device, 21*b*: first backflow prevention device, 21*c*: first backflow prevention device, 21*d*: first backflow prevention device, 22*a*: second backflow prevention device, 22*b*: second backflow prevention device, 22*c*: second backflow prevention device, 22*d*: second backflow prevention device, 23*a*: first opening and closing device, 23*b*: first opening and closing device, 23*c*: first opening and closing device, 23*d*: first opening and closing device, 24*a*: second opening and closing device, 24*b*: second opening and closing device, 24*c*: second opening and closing device, 24*d*: second opening and closing device, 25: load-side expansion device, 25*a*: load-side expansion device, 25*b*: load-side expansion device, 25*c*: load-side expansion device, 25*d*: load-side expansion device, 26*a*: load-side heat exchanger, 26*b*: load-side heat exchanger, 26*c*: load-side heat exchanger, 26*d*: load-side heat exchanger, 27: second relay expansion device, 29: gas-liquid separator, 30: first relay expansion device, 31*a*: inlet-side temperature sensor, 31*b*: inlet-side temperature sensor, 31*c*: inlet-side temperature sensor, 31*d*: inlet-side temperature sensor, 32*a*: outlet-side temperature sensor, 32*b*: outlet-side temperature sensor, 32*c*: outlet-side temperature sensor, 32*d*: outlet-side temperature sensor, 33: first relay-expansion-device inlet-side pressure sensor, 34: first relay-expansion-device outlet-side pressure sensor, 35*a*: relay heat exchanger, 35*b*: relay heat exchanger, 36*a*: opening and closing device, 36*b*: opening and closing device, 38*a*: relay expansion device, 38*b*: relay expansion device, 39*a*: relay flow switching device, 39*b*: relay flow switching device, 40: discharge pressure sensor, 41*a*: pump, 41*b*: pump, 43: discharge temperature sensor, 46: outside-air temperature sensor, 50*a*: first heat-medium flow switching device, 50*b*: first heat-medium flow switching device, 50*c*: first heat-medium flow switching device, 50*d*: first heat-medium flow switching device, 51*a*: second heat-medium flow switching device, 51*b*: second heat-medium flow switching device, 51*c*: second heat-medium flow switching device, 51*d*: second heat-medium flow switching device, 52*a*: heat-medium flow rate control device, 52*b*: heat-medium flow rate control device, 52*c*: heat-medium flow rate control device, 52*d*: heat-medium flow rate control device, 60: controller, 70: heat medium pipe, 100: air-conditioning apparatus, 101: refrigerant circuit, 102: heat medium circuit, 131: high-pressure connection pipe, 132: low-pressure connection pipe, 133: first container, 134: first pressure chamber, 135: second pressure chamber, 136: first partitioning part, 137: second partitioning part, 138: coupling part, 139: first valve body part, 140: space, 141: switching pipe, 142: switching pipe, 143: switching pipe, 144: switching pipe, 145: pressure switching unit, 146: second container, 147*a*: first communication flow passage, 147*b*: second communication flow passage, 148: second valve body part, 149: driving part, 150: electromagnet, 151: plunger, 152: spring, 153: brace.

The invention claimed is:

1. An air-conditioning apparatus comprising:

an outdoor unit including a compressor and a heat-source-side heat exchanger, the compressor being configured to compress refrigerant and discharge the compressed refrigerant, the heat-source-side heat exchanger being configured to cause heat exchange to be performed between the refrigerant and outside air; and a relay unit configured to form, together with the outdoor unit, a refrigerant circuit, wherein the relay unit includes a relay heat exchanger configured to cause heat exchange to be performed between the refrigerant and a heat medium, wherein the outdoor unit includes a first flow switching device and a second flow switching device each configured to switch an associated flow passage for the refrigerant between a plurality of flow passages, in accordance with an operation mode, an outflow pipe through which the refrigerant flows from the outdoor unit to the relay unit and an inflow pipe through which the refrigerant flows from the relay unit into the outdoor unit are provided between the outdoor unit and the relay unit, the compressor and the first flow switching device are connected to each other, the first flow switching device and the second flow switching device are connected to each other, the first flow switching device and the outflow pipe are connected to each other, the inflow pipe and the second flow switching device are connected to each other, the first flow switching device and the second flow switching device are pilot four-way flow switching valves each configured to switch an associated flow passage between a plurality of flow passages, based on a differential pressure, the pilot four-way flow switching valves each respectively includes a high-pressure connection pipe and a low-pressure connection pipe, the high-pressure connection pipe is connected with an atmosphere of the refrigerant whose pressure is higher than a pressure of an atmosphere of low-pressure refrigerant with which the low-pressure connection pipe is connected, and the pilot four-way flow switching devices that are the first flow switching device and the second flow switching device each respectively includes a pressure switching valve configured to switch refrigerant to flow in an associated one of the pilot four-way flow switching valves between the high-pressure refrigerant that flows through the high-pressure connection pipe and the low-pressure refrigerant that flows though the low-pressure connection pipe.

2. The air-conditioning apparatus of claim 1, wherein the operation mode includes a cooling operation mode, and in the cooling operation mode, the refrigerant discharged from the compressor flows through a first flow passage of the first flow switching device and the heat-source-side heat exchanger in this order, then flows through a first flow passage of the second flow switching device, a second flow passage of the first flow switching device, and the outflow pipe in this order, and flows into the relay unit, and the refrigerant flows out of the relay unit, flows through the inflow pipe, then flows through a second flow passage of the second flow switching device, and flows into the compressor.

3. The air-conditioning apparatus of claim 2, wherein the operation mode includes a cooling main operation mode in which a cooling and heating mixed operation is performed using the cooling operation mode.

4. The air-conditioning apparatus of claim 1, wherein the operation mode includes a heating operation mode, and in the heating operation mode, the refrigerant discharged from the compressor flows through a third flow passage of the first flow switching device, then flows through the outflow pipe, and flows into the relay unit, and the refrigerant flows out of the relay unit, flows through the inflow pipe, then flows through a third flow passage of the second flow switching device, the heat-source-side heat exchanger, a fourth flow passage of the first flow switching device, and a fourth flow passage of the second flow switching device in this order, and flows into the compressor.

5. The air-conditioning apparatus of claim 4, wherein the operation mode includes a heating main operation mode in which a cooling and heating mixed operation is performed using the heating operation mode.

6. The air conditioning-apparatus of claim 1, wherein the operation mode includes a cooling operation mode and a heating operation mode, in the cooling operation mode, the refrigerant discharged from the compressor flows through a first flow passage of the first flow switching device and the heat-source-side heat exchanger in this order, then flows through a first flow passage of the second flow switching device, a second flow passage of the first flow switching device, and the outflow pipe in this order, and flows into the relay unit, and the refrigerant flows out of the relay unit, flows through the inflow pipe, then flows through a second flow passage of the second flow switching device, and flows into the compressor, and in the heating operation mode, the refrigerant discharged from the compressor flows through a third flow passage of the first flow switching device, then flows through the outflow pipe, and flows into the relay unit, and the refrigerant flows out of the relay unit, flows through the inflow pipe, then flows through a third flow passage of the second flow switching device, the heat-source-side heat exchanger, a fourth flow passage of the first flow switching device, and a fourth flow passage of the second flow switching device in this order, and flows into the compressor.

7. The air-conditioning apparatus of claim 6, wherein the first flow switching device and the second flow switching device are provided such that the first flow passage, the second flow passage, the third flow passage, and the fourth flow passage are allowed to be opened and closed, in the cooling operation mode, the first flow passage and the second flow passage are switched to be opened, and the third flow passage and the fourth flow passage are switched to be closed, and in the heating operation mode, the third flow passage and the fourth flow passage are switched to be opened, and the first flow passage and the second flow passage are switched to be closed.

8. The air-conditioning apparatus of claim 6, wherein the pilot four-way flow switching valves each include a first pressure chamber and a second pressure chamber that are provided in a first container, the first pressure chamber being connected to one of high-pressure refrigerant from the high-pressure connection pipe and low-pressure refrigerant from the low-pressure connection pipe, the second pressure chamber being connected with the other of the high-pressure refrigerant from the high-pressure connection pipe and the low-pressure refrigerant from the low-pressure connection pipe, a pressure state of the first pressure chamber being opposite to a pressure state of the second pressure chamber, a first partitioning part and a second partitioning part that are provided between the first pressure chamber and the second pressure chamber in the first container such that a space in the first pressure chamber and a space in the second pressure chamber are increased and decreased in an inversely correlated manner, the first partitioning part partitioning the first container to define the first pressure chamber, the second partitioning part partitioning the first container to define the second pressure chamber, a coupling provided between the first partitioning part and the second partitioning part, with spaces provided between the first partitioning part and the second partitioning part, the coupling coupling the first partitioning part and the second partitioning part, and a first valve body part provided in a middle of the coupling, the first valve body part being slidable between the first pressure chamber and the second pressure chamber such that a distance between the first valve body part and the first pressure chamber and a distance between the first valve body part and the second pressure chamber are increased and decreased in an inversely correlated manner, wherein four switching pipes are connected with a space between the first partitioning part and the second partitioning part in the first container, and form the first flow passage, the second flow passage, the third flow passage, and the fourth flow passage, respectively, wherein of the four switching pipes, three switching pipes are arranged in parallel in a slidable range of the first valve body part, wherein the first valve body part is configured to cause the switching pipe connected to inlet sides of the second flow passage and the fourth flow passage to communicate with the inside of the first valve body part at all times, and is configured to be slid in the slidable range to cause one of the two switching pipes connected to outlet sides of the second flow passage and the fourth flow passage to communicate with the inside of the first valve body part, in accordance with pressures of the refrigerant connected to the first pressure chamber and the second pressure chamber, and wherein high-pressure refrigerant flows in a space that is provided between the switching pipe connected to inlet sides of the first flow passage and the third flow passage and located outside the first valve body part and one of the switching pipes that does not form one of the second flow passage and the fourth flow passage, the space being also provided between the first partitioning part and the second partitioning part in the first container.

9. The air-conditioning apparatus of claim 8, wherein the high-pressure connection pipe in the first flow switching device is connected with an atmosphere of the high-pressure refrigerant in the switching pipe connected to the inlet sides of the first flow passage and the third flow passage of the first flow switching device, and the low-pressure connection pipe in the first flow switching device is connected with an atmosphere of the low-pressure refrigerant in the switching pipe connected to the inlet sides of the second flow passage and the fourth flow passage of the first flow switching device.

10. The air-conditioning apparatus of claim 8, wherein the high-pressure connection pipe in the second flow switching device is connected with an atmosphere of the high-pressure refrigerant in the switching pipe connected to the inlet sides of the first flow passage and the third flow passage of the second flow switching device, and the low-pressure connection pipe in the second flow switching device is connected with an atmosphere of the low-pressure refrigerant in the switching pipe connected to the inlet sides of the second flow passage and the fourth flow passage of the second flow switching device.

11. The air-conditioning apparatus of claim 8, wherein the pressure switching valve includes a second container to which the high-pressure connection pipe and the low-pressure connection pipe are connected, a second valve body part provided in the second container, configured to cause a connection part of the low-pressure connection pipe to communicate with inside of the second valve body part at all times, and configured to be slid in a slidable range to cause one of a connection part of a first communication flow passage communicating with the first pressure chamber and a connection part of a second communication flow passage communicating with the second pressure chamber to communicate with the inside of the second valve body part, and a driver configured to slide the second valve body part.

12. The air-conditioning apparatus of claim 6, wherein the operation mode includes a cooling main operation mode in which a cooling and heating mixed operation is performed using the cooling operation mode.

13. The air-conditioning apparatus of claim 6, wherein the operation mode includes a heating main operation mode in which a cooling and heating mixed operation is performed using the heating operation mode.

14. The air-conditioning apparatus of 6, further comprising an expansion valve that is provided downstream of the heat-source-side heat exchanger when the heat-source-side heat exchanger is used as a condenser.

15. The air-conditioning apparatus of claim 14, wherein in the cooling operation mode, an opening degree of the expansion valve is adjusted such that in the first flow switching device, a pressure in the first flow passage is higher than pressure in the second flow passage, and in the heating operation mode, the opening degree of the expansion valve is adjusted such that in the second flow switching device, a pressure in the third flow passage is higher than a pressure in the fourth flow passage.

16. The air-conditioning apparatus of claim 1, wherein the high-pressure connection pipe is connected with an atmosphere of the high-pressure refrigerant between a discharge side of the compressor and the first flow switching device, and the low-pressure connection pipe is connected with an atmosphere of the low-pressure refrigerant between the second flow switching device and a suction side of the compressor.

17. The air-conditioning apparatus of claim 1, further comprising an expansion valve that is provided downstream of the heat-source-side heat exchanger when the heat-source-side heat exchanger is used as a condenser.

18. The air-conditioning apparatus of claim 1, wherein the outdoor unit includes two heat-source-side heat exchangers including the heat-source-side heat exchanger, and arranged in parallel, one of the heat-source-side exchangers being connected to the first flow switching device by a pipe, a third flow switching device connected to the other of the heat-source-side heat exchangers by a pipe, and configured to cause the refrigerant to flow in parallel with the refrigerant that is caused to flow by the first flow switching device, and a check valve provided at a pipe located between the inflow pipe and the third flow switching device.

19. The air-conditioning apparatus of claim 1, further comprising one or more indoor units each of which includes a load-side heat exchanger connected to the relay unit by a pipe, and is included in the refrigerant circuit.

20. The air-conditioning apparatus of claim 1, further comprising one or more indoor units each of which includes a load-side heat exchanger connected to the relay heat exchanger in the relay unit by a pipe through which the heat medium flows, and which form, together with the relay unit, a heat medium circuit.

* * * * *